US008296143B2

(12) United States Patent
Kudoh

(10) Patent No.: US 8,296,143 B2
(45) Date of Patent: Oct. 23, 2012

(54) AUDIO SIGNAL PROCESSING APPARATUS, AUDIO SIGNAL PROCESSING METHOD, AND PROGRAM FOR HAVING THE METHOD EXECUTED BY COMPUTER

(75) Inventor: Takuma Kudoh, Miyagi (JP)

(73) Assignee: P Softhouse Co., ltd., Sendai-shi (JP)

( * ) Notice: Subject to any disclaimer, the term of this patent is extended or adjusted under 35 U.S.C. 154(b) by 1220 days.

(21) Appl. No.: 11/722,966

(22) PCT Filed: Dec. 26, 2005

(86) PCT No.: PCT/JP2005/023828

§ 371 (c)(1),
(2), (4) Date: Sep. 11, 2007

(87) PCT Pub. No.: WO2006/070768

PCT Pub. Date: Jul. 6, 2006

(65) Prior Publication Data

US 2008/0033726 A1 Feb. 7, 2008

(30) Foreign Application Priority Data

Dec. 27, 2004 (JP) ..... 2004-382895

(51) Int. Cl.

| | |
|---|---|
| ***G10L 13/00*** | (2006.01) |
| ***G10L 11/00*** | (2006.01) |
| ***G10L 19/14*** | (2006.01) |
| ***G10L 13/06*** | (2006.01) |
| ***G10L 19/00*** | (2006.01) |
| ***G10L 21/04*** | (2006.01) |

(52) U.S. Cl. ..... 704/258; 704/267; 704/270; 704/278; 704/205; 704/265; 704/268; 704/501; 704/503

(58) Field of Classification Search ..... 704/205, 704/265, 268, 501, 503, E21.017, E21.018, 704/258, 267, 270, 278
See application file for complete search history.

(56) References Cited

U.S. PATENT DOCUMENTS 4,435,832 A * 3/1984 Asada et al. ..... 704/262

(Continued)

FOREIGN PATENT DOCUMENTS

EP 0 982 713 A2 3/2000

(Continued)

OTHER PUBLICATIONS

P. Masri, "PhD Thesis: Computer Modeling of Sound for Transformation and Synthesis of Musical Signal," 1996.Univ. of Bristol.*

(Continued)

*Primary Examiner* — Douglas Godbold
*Assistant Examiner* — Edgar Guerra-Erazo
(74) *Attorney, Agent, or Firm* — Oblon, Spivak, McClelland, Maier & Neustadt, L.L.P.

(57) ABSTRACT

An audio waveform processing not imparting any feeling of strangeness and high in definition, in which time stretch and pitch shift are performed by a vocoder method, and the variation of phase over the whole waveform caused by the vocoder method at all times is reduced. An audio input waveform is handled as one band as it is or subjected to frequency band division into bands. While performing time stretch and pitch shift of each band waveform like conventional vocoder methods, the waveforms are combined. The combined waveform of the band is phase-synchronized at regular intervals to reduce the variation of phase. The phase-synchronized waveforms of the band are added, thus obtaining the final output waveform.

18 Claims, 23 Drawing Sheets

U.S. PATENT DOCUMENTS

| | | | | |
|---|---|---|---|---|
| 5,386,493 | A * | 1/1995 | Degen et al. | 704/267 |
| 5,479,564 | A * | 12/1995 | Vogten et al. | 704/267 |
| 5,687,240 | A * | 11/1997 | Yoshida et al. | 381/61 |
| 5,842,172 | A * | 11/1998 | Wilson | 704/503 |
| 5,920,842 | A * | 7/1999 | Cooper et al. | 704/503 |
| 6,098,046 | A * | 8/2000 | Cooper et al. | 704/503 |
| 6,169,240 | B1 * | 1/2001 | Suzuki | 84/605 |
| 6,201,175 | B1 * | 3/2001 | Kikumoto et al. | 84/605 |
| 6,421,636 | B1 * | 7/2002 | Cooper et al. | 704/205 |
| 6,484,137 | B1 * | 11/2002 | Taniguchi et al. | 704/211 |
| 6,487,536 | B1 * | 11/2002 | Koezuka et al. | 704/500 |
| 6,687,674 | B2 * | 2/2004 | Suzuki et al. | 704/268 |
| 6,973,431 | B2 * | 12/2005 | Cooper et al. | 704/503 |
| 7,206,414 | B2 * | 4/2007 | Schulz | 381/56 |
| 7,764,758 | B2 * | 7/2010 | Raby et al. | 375/355 |
| 2002/0071575 | A1 * | 6/2002 | Kumamoto et al. | 381/97 |
| 2002/0116178 | A1 | 8/2002 | Crockett | |
| 2002/0177996 | A1 * | 11/2002 | Cooper et al. | 704/205 |
| 2002/0178006 | A1 * | 11/2002 | Suzuki et al. | 704/258 |
| 2003/0009336 | A1 * | 1/2003 | Kenmochi et al. | 704/258 |
| 2003/0050781 | A1 * | 3/2003 | Tamura et al. | 704/267 |
| 2003/0055646 | A1 | 3/2003 | Yoshioka et al. | |
| 2003/0055647 | A1 | 3/2003 | Yoshioka et al. | |
| 2003/0061047 | A1 | 3/2003 | Yoshioka et al. | |
| 2003/0083886 | A1 | 5/2003 | Den Brinker et al. | |
| 2004/0122662 | A1 | 6/2004 | Crockett | |
| 2004/0254660 | A1 * | 12/2004 | Seefeldt | 700/94 |
| 2006/0107822 | A1 * | 5/2006 | Bowen | 84/612 |
| 2006/0271372 | A1 * | 11/2006 | Escott et al. | 704/278 |

FOREIGN PATENT DOCUMENTS

| | | | |
|---|---|---|---|
| EP | 1377967 | A2 | 1/2004 |
| EP | 1446796 | A1 | 8/2004 |
| JP | 5-297895 | | 11/1993 |
| JP | 2000-3188 | | 1/2000 |
| JP | 2000-3197 | | 1/2000 |
| JP | 2000-3199 | | 1/2000 |
| JP | 2000-10597 | | 1/2000 |
| JP | 2000-10599 | | 1/2000 |
| JP | 2000-122699 | | 4/2000 |
| JP | 2001-117595 | | 4/2001 |
| JP | 2003-22100 | | 1/2003 |
| JP | 2004-527000 | | 9/2004 |
| JP | 2005-506582 | | 3/2005 |
| WO | WO 02/084645 | A2 | 10/2002 |
| WO | WO 03/036620 | A1 | 5/2003 |

OTHER PUBLICATIONS

Bello, J.P.; Duxbury, C.; Davies, M.; Sandler, M., "On the use of phase and energy for musical onset detection in the complex domain," Signal Processing Letters, IEEE, vol. 11, No. 6, pp. 553-556, Jun. 2004.*

Jan O. Borchers, et al., "Personal Orchestra: Conducting Audio/Video Music Recordings", Proceedings of the Second International Conference on WEB Delivering of Music, XP010626949, Dec. 9, 2002, 8 pages.

Jean LaRoche, "Autocorrelation Method for High-Quality Time/Pitch-Scaling", Applications of Signal Processing to Audio and Acoustics, Final Program and Paper Summaries, XP010130061, Oct. 17, 1993, 4 pages.

Jennifer Yuen, et al., "Hybrid Sampling-Wavetable Synthesis with Genetic Algorithms", Journal of the Audio Engineering Society, vol. 45, No. 5, XP000700664, May 1, 1997, pp. 316-330.

* cited by examiner

FIG.13

| ADDRESS | START OF FRAME | | END OF FRAME | | INSTANTANEOUS ANGULAR FREQUENCY |
|---|---|---|---|---|---|
| | AMPLITUDE | PHASE | AMPLITUDE | PHASE | |
| addr (0) | AS00 | PS00 | AE00 | PE00 | W00 |
| addr (1) | AS01 | PS01 | AE01 | PE01 | W01 |
| addr (2) | AS02 | PS02 | AE02 | PE02 | W02 |
| addr (3) | AS03 | PS03 | AE03 | PE03 | W03 |
| | | | | | |
| addr (11) | AS11 | PS11 | AE11 | PE11 | W11 |

AUDIO SIGNAL PROCESSING APPARATUS, AUDIO SIGNAL PROCESSING METHOD, AND PROGRAM FOR HAVING THE METHOD EXECUTED BY COMPUTER

TECHNICAL FIELD

The present invention relates to audio waveform processing for performing time stretching and pitch shifting by a vocoder method.

BACKGROUND ART

Time stretching is a process of expanding and compressing only a time axis of an audio waveform without changing a pitch thereof. Pitch shifting is a process of changing only the pitch without changing the time axis. There is a so-called vocoder method as a heretofore known audio waveform processing for performing the time stretching and the pitch shifting (refer to Patent Document 1 for instance). This method analyzes a frequency of an inputted audio waveform, compresses or expands the time axis on the time stretching, and scales the frequency of an outputted waveform and then adds each frequency component on the pitch shifting.

In the case of a conventional vocoder methods there is a great change in a phase between an audio input waveform and a time-stretched and/or pitch-shifted waveform. FIGS. 7A and 7B show the change in the phase generated when time-stretching a certain 2-channel stereo audio waveform as an example. A horizontal axis of a graph represents the time axis, and a vertical axis represents the phase of the frequency component. FIG. 7A shows phase changes of components A and B in a frequency band having two channels obtained as a result of frequency analysis of the audio input waveform. FIG. 7B shows phases of A1 and B1 corresponding to A and B obtained when the waveform of FIG. 7A is time-compressed to ½ by the vocoder method. The time axis becomes ½ times, and the vertical axis representing the phase also becomes ½ times.

Here, attention is focused on time T before the stretch process and time T1 (=T/2) after the time compression. In the graph of FIG. 7A before the process, a phase difference between A and B at the time T is $2\pi$, and hence the phase difference is 0 if expressed as $-\pi$ to $\pi$. The components A and B undergo a transition with the phase difference of 0 even after the time T. The phase difference between A1 and B1 at the time T1 after the time compression is $\pi$, and A1 and B1 undergo a transition with the phase difference $\pi$ even after the time T1. Thus, the phase relation between A1 and B1 has apparently changed from that of A and B before the time compression.

As is evident from the above description, the vocoder method expands and compresses the time axis so that a lag or a lead of the phase occurs by the amount of expansion and compression. This also applies to the pitch shifting. A phase change amount is different among the frequency components having undergone the frequency analysis, and is also different among the channels in the case of a stereo audio. For this reason, there arises an auditory sense of discomfort due to, for example, mutual cancellation of sounds or a lack of feeling of normalcy of a stereo sound. Therefore, the time stretching and the pitch shifting of high quality cannot be realized.

The techniques for improving the vocoder method and improving sound quality have also been proposed. For instance, Patent Document 1 discloses an audio waveform device wherein attention is focused on a pre-echo generated on performing band division in an attack portion, in which a level of the audio waveform greatly changes, and the phase is reset at the beginning of a section of the pre-echo.

Patent Document 1: Japanese Patent Application Laid-Open No. 2001-117595

DISCLOSURE OF INVENTION

Problem to be Solved by the Invention

However, the audio waveform device disclosed in Patent Document 1 was made in view of keeping an attack feeling, and no notice is taken of the phase change after the attack. There is also a problem that it is difficult to detect the attack portion as to a complicatedly mixed tune.

The present invention relates to the audio waveform processing for performing the time stretching and the pitch shifting by the vocoder method, and an object thereof is to realize audio waveform processing of high quality which does not cause auditory sense of discomfort and which reduces the phase change invariably occurring in the vocoder method through the entire waveform.

Means for Solving Problem

To attain the object, an audio signal processing apparatus, an audio signal processing method, and a program for having the method executed by a computer according to the present invention handle an audio input waveform as-is as one band (the band refers to a frequency band, and the frequency band is hereinafter referred to as the band) or divide it into multiple bands by the frequency band, synthesize the waveform while performing time expansion/compression and pitch conversion to each band waveform as with the conventional vocoder method, and perform phase synchronization processing to a synthesized waveform of each band at regular intervals so as to reduce the phase change. Furthermore, the waveforms of respective bands after the phase synchronization processing are added to be a final output waveform.

According to one aspect of the present invention, an audio signal processing apparatus includes a frequency band dividing unit that divides an input audio signal into a plurality of bands, a plurality of time stretch/pitch shift processing units that perform at least one of time stretching and pitch shifting respectively by carrying out sine or cosine oscillation of each frequency component on the basis of a result of frequency analysis of a band-divided audio signal obtained as a result of division into the plurality of bands and a required time stretch/pitch shift amount, and performing a synthesis process, and a plurality of phase synchronization processing units that perform phase synchronization process for adjusting phases of time stretch/pitch shift signals outputted by the plurality of time stretch/pitch shift processing units, respectively, the audio signal processing apparatus thereby synthesizing outputs of the plurality of phase synchronization processing units and outputting a result, wherein each of the phase synchronization processing units includes a reference signal generating unit that clips a waveform of an end portion in one frame from the band-divided audio signal once every plurality of frames and transforms the clipped waveform of the end portion on the basis of the time stretch/pitch shift amount to generate and output a reference signal for the phase synchronization process, across-bade location calculating unit that searches a tail portion of a time axis waveform of the time stretch/pitch shift signal in a plurality of frames for locations at which the time axis waveform of the time stretch/pitch shift signal in the plurality of frames is similar to a waveform of the reference signal on a time axis, and detects the locations determined to be similar as cross-fade locations for the phase synchronization process in the plurality of frames, and a cross-fade processing unit that performs a cross-fade process from the time stretch/pitch shift signal to the reference signal at each of the detected cross-fade locations.

In the audio signal processing apparatus according to another aspect of the present invention, the cross-fade location calculating unit may find the cross-fade locations by using a predetermined evaluation function that evaluates the similarity.

In the audio signal processing apparatus according to another aspect of the present invention, the cross-fade processing unit may output a difference between a signal length after the cross-fade process and an original signal length as a stretch correction value, and the time stretch/pitch shift processing unit may use the stretch correction value to correct a next signal length.

In the audio signal processing apparatus a cording to another aspect of the present invention, the cross-fade location calculating unit may create a weighting gradient on the evaluation function so that an evaluation of the similarity is higher toward the tail portion of the time stretch/pitch shift signal in the plurality of frames.

According to another aspect of the present invention, an audio signal processing apparatus includes a time stretch/pitch shift processing unit that performs each of at least one of time stretching and pitch shifting by carrying out sine or cosine oscillation of each frequency component on the basis of a result of frequency analysis of an input audio signal and a required time stretch/pitch shift amount, and performing a synthesis process, and a phase synchronization processing unit that performs phase synchronization process for adjusting a phase of a time stretch/pitch shift signal outputted by the time stretch/pitch shift processing unit and outputs a resulting signal, wherein the phase synchronization processing unit includes a reference signal generating unit that clips a waveform of an end portion in one frame from the input audio signal once every plurality of frames and transforms the clipped waveform of the end portion on the basis of the time stretch/pitch shift amount to generate and output a reference signal for the phase synchronization process, a cross-fade location calculating unit that searches a tail portion of a time axis waveform of the time stretch/pitch shift signal in a plurality of frames for locations at which the time axis waveform of the time stretch/pitch shift signal in the plurality of frames is similar to a waveform of the reference signal on a time axis, and detects locations determined to be similar as cross-fade locations for the phase synchronization process in the plurality of frames, and a cross-fade processing unit that performs a cross-fade process from the time stretch/pitch shift signal to the reference signal at each of the detected cross-fade locations.

According to another aspect of the present invention, an audio signal processing apparatus includes a frequency band dividing unit that divides an input audio signal into a plurality of bands, a plurality of time stretch/pitch shift processing units that perform at least one of time stretching and pitch shifting respectively by carrying out sine or cosine oscillation of each frequency component on the basis of a result of frequency analysis of a band-divided audio signal obtained as a result of division into the plurality of bands and a required time stretch/pitch shift amount, and performing a synthesis process, and a plurality of phase synchronization processing units that perform phase synchronization process for adjusting phases of time stretch/pitch shift signals outputted by the plurality of time stretch/pitch shift processing units, respectively, the audio signal processing apparatus thereby synthesizing outputs of the plurality of phase synchronization processing units and outputting a result, and each of the phase synchronization processing units includes a phase synchronization signal generating unit that evaluates a difference in phase condition between an end portion of a waveform of the time stretch/pitch shift signal in a current frame on which the time stretch/pitch shift processing is performed and a waveform of the band-divided audio signal at a location where a next frame starts, by shifting the location at which the next frame of the waveform of the band-divided audio signal starts, along a time axis, calculates a time shift amount when the difference in phase condition is evaluated as the smallest, clips a signal waveform corresponding to a predetermined wavelength from the end portion of the band-divided audio signal, and generates at least one of a phase-lead signal and a phase-lag signal which is shifted by the time shift amount from the clipped waveform of the end portion as a phase synchronization signal, and a cross-fade processing unit that performs a cross-fade process from the time stretch/pitch shift signal to the phase synchronization signal at the end portion of the time stretch/pitch shift signal.

In the audio signal processing apparatus according to another aspect of the present invention, each of the phase synchronization processing units may use a distance on a complex-number plane between the end portion of the waveform of the time stretch/pitch shift signal in the current frame on which time the stretch/pitch shift processing is performed and the waveform of the band-divided audio signal at the location where the next frame starts, as an evaluation function for evaluating the difference in phase condition between the end portion of the waveform of the time stretch/pitch shift signal in the current frame on which the time stretch/pitch shift processing is performed and the waveform of the band-divided audio signal at the location where the next frame starts.

In the audio signal processing apparatus according to another aspect of the present invention, the phase synchronization signal generating unit may calculates a phase correction value for the phase synchronization process in the next frame on the bases of the time shift amount, and the time stretch/pitch shift processing unit may correct a phase of the time stretch/pitch shift signal at the start of the next frame on the basis of the phase correction value outputted by the phase synchronization signal generating unit.

In the audio signal processing apparatus according to another aspect of the present invention, each of the phase synchronization processing units may perform a weighting on evaluating the difference in phase condition so that an evaluation value that evaluates the difference in phase condition is smaller as the time shift amount is away from the location where the next frame of the waveform of the band-divided audio signal starts.

According to another aspect of the present invention, an audio signal processing apparatus includes a time stretch/pitch shift processing unit that performs each of at least one of time stretching and pitch shifting by carrying out sine or cosine oscillation of each frequency component on the basis of a result of frequency analysis of an input audio signal and a required time stretch/pitch shift amount, and performing a synthesis process, and a phase synchronization processing unit that performs phase synchronization process for adjusting a phase of a time stretch/pitch shift signal outputted by the time stretch/pitch shift processing unit and outputs a resulting signal, wherein the phase synchronization processing unit includes a phase synchronization signal generating unit that evaluates a difference in phase condition between an end portion of a waveform of the time stretch/pitch shift signal in a current frame on which time stretch/pitch shift processing is performed and a waveform of the input audio signal at a location where a next frame starts, by shifting the location at which the next frame of the waveform of the input audio signal starts, along the time axis, calculates a time shift amount when the difference in phase condition is evaluated as the smallest, clips a signal waveform corresponding to a predetermined wavelength at the end portion of the input audio signal, and generates one of phase-lead signal and phase-lag signal which is shifted by the time shift amount from the clipped waveform of the end portion as a phase synchronization signal, and a cross-fade processing unit that performs a cross-fade process from the time stretch/pitch shift signal to the phase synchronization signal at the end portion of the time stretch/pitch shift signal.

According to another aspect of the present invention, an audio signal processing method includes time stretching/pitch shifting of performing each of at least one of time stretching and pitch shifting by carrying out sine or cosine oscillation of each frequency component on the basis of a result of frequency analysis of an input audio signal and a required time stretch/pitch shift amount, and performing a synthesis process, and phase synchronization processing of performing a phase synchronization process for adjusting a phase of a time stretch/pitch shift signal on which time stretch/pitch shift processing is performed, wherein the phase synchronization processing includes reference signal generating of clipping a waveform of an end portion in one frame from the input audio signal once every plurality of frames and transforming the clipped waveform of the end portion on the basis of the time stretch/pitch shift amount to generate and output a reference signal for the phase synchronization process, cross-fade location calculating of searching a tail portion of a time axis waveform of the time stretch/pitch shift signal in a plurality of frames for locations at which the time axis waveform of the time stretch/pitch shift signal in the plurality of frames is similar to a waveform of the reference signal on a time axis, and detecting locations determined to be similar as cross-fade locations for the phase synchronization process in the plurality of frames, and cross-fade processing of performing a cross-fade process from the time stretch/pitch shift signal to the reference signal at each of the detected cross-fade locations.

In the audio signal processing method according to another aspect of the present invention, in the cross-fade location calculating, the cross-fade locations may be calculated by means of a predetermined evaluation function that evaluates the similarity, and a weighting gradient may be created on the evaluation function at a time of calculating the cross-fade locations so that an evaluation of the similarity is higher toward a tail portion of the time stretch/pitch shift signal in the plurality of frames, in the cross-fade processing, a difference between a signal length after the cross-fade process and an original signal length may be outputted as a stretch correction value, and in the time stretch/pitch shift processing, the stretch correction value may be used to correct a next signal length.

In the audio signal processing method according to another aspect of the present invention, the input audio signal may be divided into a plurality of bands, each of processes in the time stretching/pitch shifting and the phase synchronization processing may be performed on each of band-divided audio signals obtained as a result of division into he plurality of bands, and the audio signals processed may be synthesized and outputted.

According to another aspect of the present invention, an audio signal processing method includes time stretching/pitch shifting of performing each of at least one of time stretching and pitch shifting by carrying out sine or cosine oscillation of each frequency component on the basis of a result of frequency analysis of an input audio signal and a required time stretch/pitch shift amount, and performing a synthesis process, and phase synchronization processing of performing a phase synchronization process for adjusting a phase of a time stretch/pitch shift signal on which time stretch/pitch shift processing is performed, wherein the phase synchronization processing includes evaluating of evaluating a difference in phase condition between a waveform of an end portion of the time stretch/pitch shift signal in a current frame on which the time stretch/pitch shift processing is performed and a waveform of the input audio signal at a location where a next frame starts, by shifting the location where the next frame of the waveform of the input audio signal starts along a time axis, and time shift calculating of calculating a time shift amount when the difference in phase condition is evaluated as the smallest, phase synchronization signal generating of clipping a signal waveform corresponding to a predetermined wavelength at the end portion of the input audio signal, and generating one of a phase-lead signal and a phase-lag signal which is shifted by the time shift amount from the clipped waveform of the end portion as a phase synchronization signal, and cross-fade processing of performing a cross-fade process from the time stretch/pitch shift signal to the phase synchronizing signal at the end portion of the time stretch/pitch shift signal.

The audio signal processing method according to another aspect of the present invention may further include phase correction value calculating of calculating a phase correction value for the phase synchronization process in the next frame on the basis of the time shift amount, wherein in the phase synchronization processing, a distance on a complex-number plane between the end portion of the waveform of the time stretch/pitch shift signal in the current frame on which the time stretch/pitch shift processing may be performed and the waveform of the input audio signal at the location where the next frame starts is used as an evaluation function for evaluating the difference in phase condition between the end portion of the waveform of the time stretch/pitch shift signal in the current frame on which the time stretch/pitch shift processing may be performed and the waveform of the input audio signal at the location where the next frame starts, and a weighting may be performed at a time of evaluating the difference in phase condition so that an evaluation value that evaluates the difference in phase condition is smaller as the time shift amount is away from the location where the next frame of the waveform of the input audio signal starts, and in the time stretch/pitch shift processing, a phase of the time stretch/pitch shift signal at the start of the next frame may be corrected on the basis of the phase correction value generated in the phase correction value calculating.

In the audio signal processing method according to another aspect of the present invention, the input audio signal may be divided into a plurality of bands, each of processes in the time stretching/pitch shifting and the phase synchronization processing may be performed on each of band-divided audio signals obtained as a result of division into the plurality of bands, and the audio signals processed may be synthesized and outputted.

According to another aspect of the present invention, a program that causes a computer to execute the method according one aspect of the present invention is provided.

The phase synchronization processing of the present invention is to evaluate similarities of the synthesized waveform having undergone the time expansion/compression and the pitch conversion in each band to its original band waveform by shifting time series and to perform the cross-fade process on a location determined to be highly similar so as to turn the synthesized waveform back to the original band waveform. As a result thereof, the waveform at a time point when the phase synchronization processing is finished, that is the time point when the cross-fade process is finished is in the same phase condition as the original band waveform. Evaluation of the similarities is intended to lessen discontinuities caused by the cross-fade process and to obtain the waveform which does not cause an auditory sense of discomfort.

FIGS. 8A and 8B show the effects of the phase synchronization processing FIG. 8A shows the phase condition of the same audio input waveform as FIG. 7A. In FIG. 8B, the waveform of FIG. 8A is time-compressed to ½ while the phase synchronization processing is performed at time T1 (=T/2). Reference characters A2 and B2 denote phases of frequency components corresponding to A and B of FIG. 8A respectively.

As for the time compression by the conventional vocoder method shown in FIGS. 7A and 7B, a phase relation between A1 and B1 at time T1 has changed from its original form. As is evident in FIGS. 8A and 8B however, the phase of A2 is 6.5π and the phase of B2 is 8.5π at the time T1 when the phase synchronization processing is performed. It can be seen that the difference is 2π and so there is no longer the phase difference so that the same phase relation as that between the original A and B is kept.

As is evident from the above description, the phase relation of the original waveform is kept by the phase synchronization processing to the synthesized waveform having undergone time stretch and pitch shift processing by the vocoder method. The phase synchronization processing is performed at regular intervals so that the phase relation of the original waveform is kept each timer which consequently allows the time stretch and pitch shift processing to eliminate auditory sense of discomfort with the phase change reduced through the entire waveform.

Effect of the Invention

According to one aspect of the present invention, the frequency analysis and the synthesis process of the audio signal are performed as to each of the bands divided into multiple frequency bands to evaluate the similarity between the original waveform and the waveform after the synthesis process as to each band. The cross-fade process is performed at the locations of high similarity between the waveform after the synthesis process and the band original waveform so that the phase change occurring on the waveform synthesis can be reset. Thus, it is possible to obtain the audio output of high quality which does not cause auditory sense of discomfort.

According to another aspect of the present invention, the similarity between the original waveform and the waveform after the synthesis process is evaluated by regarding the audio waveform as-is as one band without performing the band division. The cross-fade process is performed at the locations of high similarity between the waveform after the synthesis process and the original waveform so that the phase change occurring on the waveform synthesis can be reset. Thus, it is possible to realize the audio output of high quality which does not cause auditory sense of discomfort with a smaller number of parts so as to realize a lower price of an audio waveform synthesizing device.

According to another aspect of the present invention, the audio waveform processing method of the present invention can be performed by a commercially available audio processing program for a personal computer so that vocoder-method audio processing of high quality can be realized at even lower prices.

According to one aspect of the present invention, the frequency analysis and the synthesis process are performed as to each of the bands of the audio signal divided into multiple frequency bands. The phase condition after the synthesis process of each band is compared with the phase condition of the original waveform to generate the waveform which is highly correlated with the phase condition after the synthesis process and is a linear phase lead or a linear phase lag of the original waveform as a phase synchronization waveform. The cross-fade process is performed to turn the waveform after the synthesis process to a phase synchronization waveform so that the phase change occurring on the waveform synthesis can be reset. Thus, it is possible to obtain the audio output of high quality which does not cause auditory sense of discomfort.

According to another aspect of the present invention, the audio waveform is processed by regarding it as-is as one band without performing the band division in the frequency band division of the apparatus of the present invention. Thus, it is possible to realize the audio output of high quality which does not cause auditory sense of discomfort with a smaller number of parts so as to realize lower prices of an audio waveform synthesizing device.

According to another aspect of the present invention, the audio waveform processing method of the present invention can be performed by a commercially available audio processing program for a personal computer so that vocoder-method audio processing of high quality can be realized at even lower prices.

According to another aspect of the present invention, a distance on a complex-number plane between the waveforms is used as an evaluation function for evaluating the difference between the phase condition after the waveform synthesis process of each band and the phase condition of the original waveform of each band. Thus, it is possible to evaluate the difference in the phase condition by a relatively simple method so as to promote simplification and speeding-up of the audio waveform synthesizing device.

To be more specific the effect of using the audio signal processing apparatus, method, and program of the present invention is that, whether the audio input waveform is monaural or stereo, the phase change invariably occurring in the conventional vocoder method is reduced through the entire waveform so that the time stretch and pitch shift processing of high quality can be realized.

BRIEF DESCRIPTION OF DRAWINGS

FIG. 13 is a diagram for describing Information stored in a memory by a frequency analysis unit;

EXPLANATIONS OF LETTERS OR NUMERALS

1 AUDIO INPUT WAVEFORM
2 FREQUENCY BAND DIVIDING UNIT
3 TIME STRETCH/PITCH SHIFT AMOUNT SETTING UNIT
4 BAND COMPONENT SYNTHESIZING UNIT
5 PHASE SYNCHRONIZATION PROCESSING UNIT
6 AUDIO OUTPUT WAVEFORM
7 TIME STRETCH AMOUNT CORRECTING UNIT
8 CHANNEL DIVISION PROCESSING UNIT
9 FREQUENCY ANALYSIS UNIT
10 TIME STRETCH/PITCH SHIFT PROCESSING UNIT
11 CHANNEL INTEGRATION PROCESSING UNIT
12 BUFFERING PROCESSING UNIT
13 REFERENCE WAVEFORM GENERATING UNIT
14 WAVEFORM SIMILARITY EVALUATION UNIT
15 CROSS-FADE PROCESSING UNIT
16 CPU (CENTRAL PROCESSING UNIT)
17 ROM (READ ONLY MEMORY)
18 RAM (RANDOM ACCESS MEMORY)
19 HARD DISK DRIVE
20 CD-ROM DRIVE
21 SPEECH OUTPUT UNIT
22 CONTROLLER GROUP
23 AUDIO INPUT WAVEFORM
24 FREQUENCY BAND DIVIDING UNIT
25 TIME STRETCH/PITCH SHIFT AMOUNT SETTING UNIT
26 BAND COMPONENT SYNTHESIZING UNIT
27 PHASE SYNCHRONIZATION PROCESSING UNIT
28 AUDIO OUTPUT WAVEFORM
29 CHANNEL DIVISION PROCESSING UNIT
30 FREQUENCY ANALYSIS UNIT
31 TIME STRETCH/PITCH SHIFT PROCESSING UNIT
32 CHANNEL INTEGRATION PROCESSING UNIT
33 BUFFERING PROCESSING UNIT
34 PHASE SYNCHRONIZATION WAVEFORM GENERATING UNIT
35 CROSS-FADE PROCESSING UNIT
36 STEREO WAVEFORM MEMORY
37 CHANNEL 0 WAVEFORM MEMORY
38 CHANNEL 1 WAVEFORM MEMORY
39 CHANNEL 0 SYNTHESIZED WAVEFORM MEMORY
40 CHANNEL 1 SYNTHESIZED WAVEFORM MEMORY
41 STEREO SYNTHESIZED WAVEFORM MEMORY
42 STEREO WAVEFORM MEMORY
43 CHANNEL 0 WAVEFORM MEMORY
44 CHANNEL 1 WAVEFORM MEMORY
45 CHANNEL 0 SYNTHESIZED WAVEFORM MEMORY
46 CHANNEL 1 SYNTHESIZED WAVEFORM MEMORY
47 STEREO SYNTHESIZED WAVEFORM MEMORY
230 INDICATOR

BEST MODES FOR CARRYING OUT THE INVENTION

Exemplary embodiments of the present invention will be described based on the drawings. The present invention will not be limited by the following embodiments unless it departs from the scope of the invention.

First Embodiment

Figure 1:
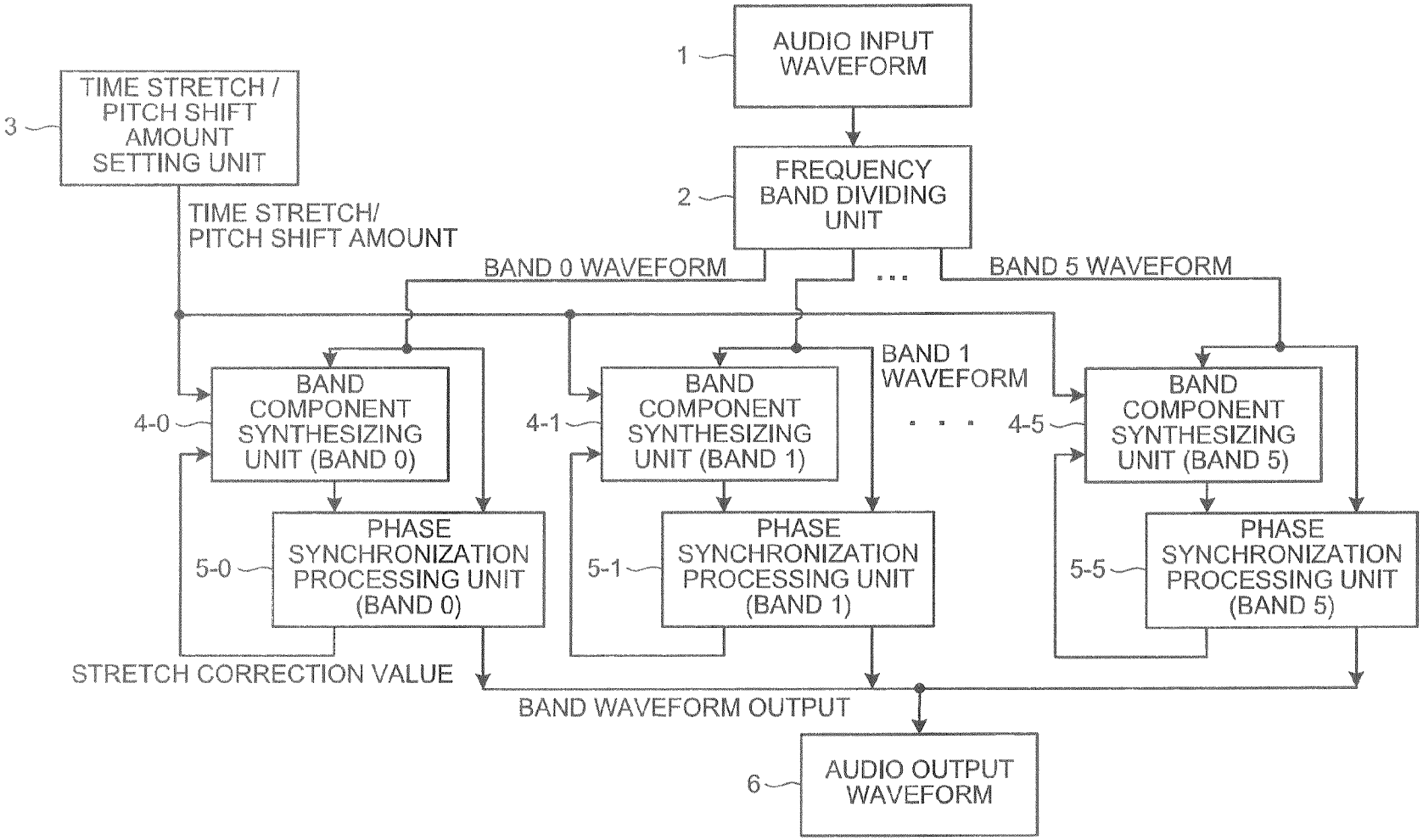
FIG. 1 is a block diagram showing a waveform processing flow according to the present invention.

FIG. 1 shows a block diagram of audio waveform processing according to a first embodiment of the present invention. Audio waveforms handled in this embodiment are digitized.

An audio input waveform 1 is divided into several bands by a frequency band dividing unit 2. This embodiment divides it into six bands. Reference numeral 3 denotes a time stretch/pitch shift amount setting unit, where a parameter is changed by an operation by a user. Band waveforms generated by the frequency band dividing unit 2 undergo a frequency analysis by band component synthesizing units 4-0 to 4-5, and the waveforms are synthesized according to a time stretch/pitch shift amount set based on a result of the frequency analysis while time expansion/compression and pitch conversion are performed.

Next, phase synchronization processing units 5-0 to 5-5 perform phase synchronization processing by using the waveforms synthesized by the band component synthesizing units 4 and a band original waveform generated by the frequency band dividing unit 2. An audio output waveform 6 is a result of additively synthesizing output waveforms of the phase synchronization processing units 5 of respective bands. As an error occurs to lengths of the waveforms outputted by the phase synchronization processing units 5, a correction value is fed back to the band component synthesizing units 4 so as to uniform the lengths of the waveforms outputted on performing synthesizing process next.

It is desirable to set the number of bands to be divided by the frequency band dividing unit 2 and the bands thereof in accordance with the audio input waveform. There are the cases where it is not necessary to divide a simple audio signal such as performance of a single instrument. Inversely, the number of divisions must be increased as to a complicatedly mixed tune. As shown in the block diagram of FIG. 1, the phase synchronization processing is performed on a per-band basis so that phase change in the band is reduced. However, there is a possibility that the phase relation among the bands may collapse. For that reason, it is necessary to use an adequate number of divisions and bands which are not too many. The audio input waveform such as music can be adequately processed when divided into a bandwidth which is one octave or so as a music scale.

Figure 2:
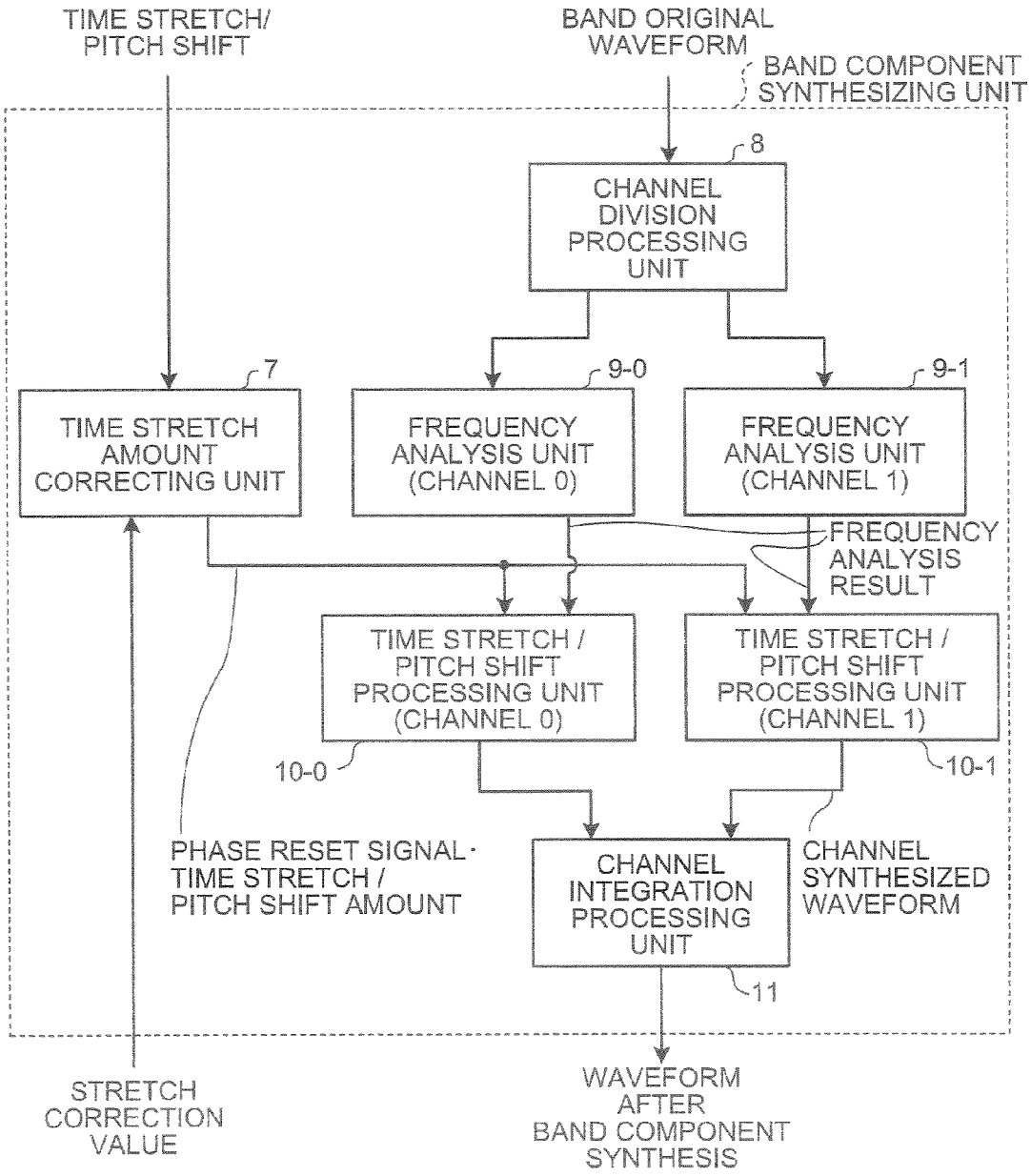
FIG. 2 is a block diagram for describing details of a band component synthesizing unit.

FIG. 2 shows details of the band component synthesizing unit 4 of FIG. 1 in a block diagram. Here, it is presumed that a stereo 2-channel audio waveform is processed. Reference numeral 7 denotes a time stretch amount correction processing unfit, which corrects a stretch amount and adds a phase reset signal in the case where an error occurs to a length of the output waveform in the phase synchronization processing units 5.

A channel division processing unit 8 of FIG. 2 divides the band waveform generated by the frequency band dividing unit 2 of FIG. 1 into channels. The number of divisions in this case is different according to the number of channels of the audio input waveform. The frequency analysis and the time stretch/pitch shift processing thereafter are performed as to each of the divided channels.

Figure 12:
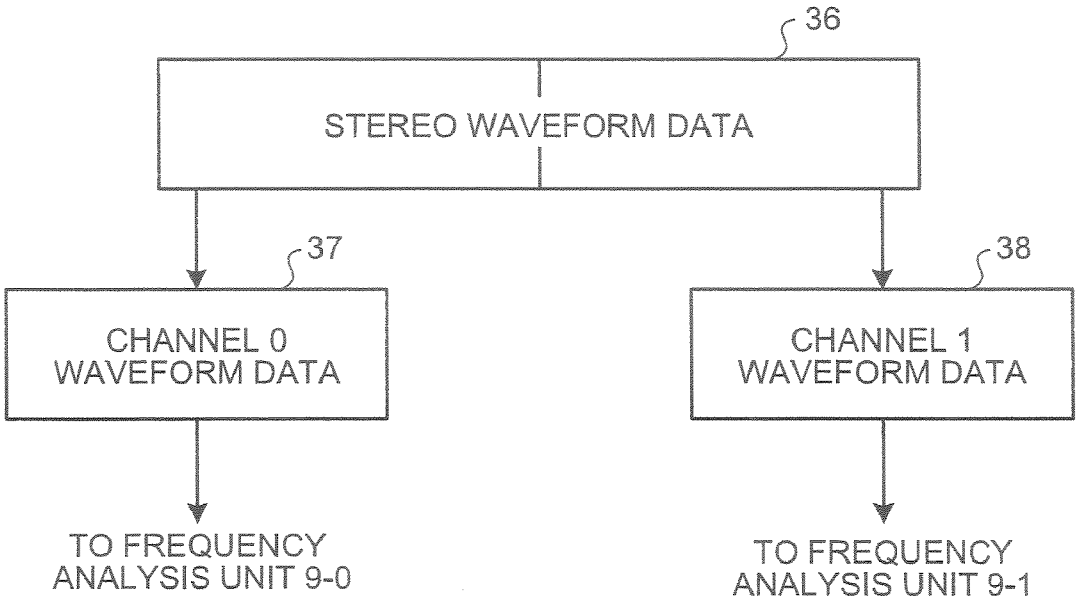
FIG. 12 is a diagram for describing details of a channel division processing unit.

FIG. 12 shows a waveform data flow of the channel division processing unit 8 of FIG. 2. A stereo waveform memory 36 has waveform data of two channels placed in one bundle therein, and the data of each channel is rearranged in a channel 0 waveform memory 37 and a channel 1 waveform memory 38 and is passed to frequency analysis units 9-0 and 9-1. In this case, the same process is also possible by passing an initial address of each channel in the waveform memory 36 to the frequency analysis units 9-0 and 9-1 instead of rearranging the data.

Next, the frequency analysis units 9-0 and 9-1 of FIG. 2 calculate frequencies, phases, and amplitudes included in the waveforms divided by the channel division processing unit 8 by using an STFFT (Short-Time Fast Fourier Transform). The length of the audio waveform analyzable by the STFFT at one time is decided by a window function to be used and an FFT size. This length is defined as one frame, and a waveform synthesis subsequently described is performed frame by frame. For instance, in the case of processing a digital audio waveform discretized at 44.1 kHz, 1024 points are used as the window function and FFT size. Thus, a width on a time axis is approximately 23.2 msec, and the data per approximately 43 Hz is acquired on a frequency axis with a good balance between a frequency resolution and a time resolution. In the case of rendering the frequency resolution higher than this, the FFT size is rendered larger. In the case of rendering the time resolution higher, the FFT size is rendered smaller. Square root and arctangent operations are performed from the data calculated by the FFT. As shown in FIG. 13, the data on an amplitude AS/AE, a phase PS/PE, and an instantaneous angular frequency W of the frequency component is stored in a memory address. It is adequate that the bandwidth of one frequency component is one halftone or so as the music scale. In the case where the bands are divided into 1-octave bandwidths by the frequency band dividing unit 2, twelve pieces of frequency component data are calculated.

Figure 14:
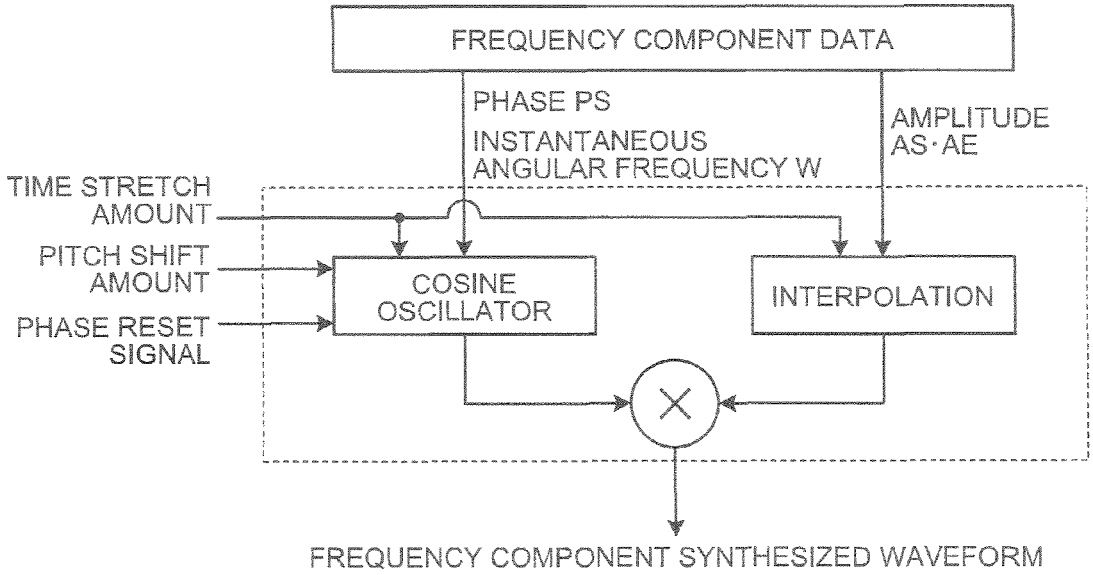
FIG. 14 is a diagram for describing time stretch and pitch shift processing.

Next, time stretch/pitch shift processing units 10-0 to 10-1 of FIG. 2 synthesize the waveforms according to the result analyzed by the frequency analysis units 9 and the required time stretch/pitch shift amounts. Sine or cosine oscillation is performed for each frequency component, and those are additively synthesized to acquire a synthesized waveform. The time axis for synthesizing the waveform is compressed or expanded according to the time stretch amount required in this case. Amplitude values are interpolated so that the amplitudes will not be discontinuous due to compression or expansion of the time axis. The angular frequency of oscillation is scaled according to the required pitch shift amount. As for the phase when starting the oscillation, the phase calculated by the frequency analysis units 9 is set on an initial operation or when a phase reset signal is inputted. In other cases the phase on finishing the oscillation of a previous frame is used as-is, and processing is performed so that the waveforms are smoothly connected between the frames. A configuration of these processes is as shown in FIG. 14. The synthesized waveform data is stored in the memory and passed to a channel integration processing unit 11.

Figure 15:
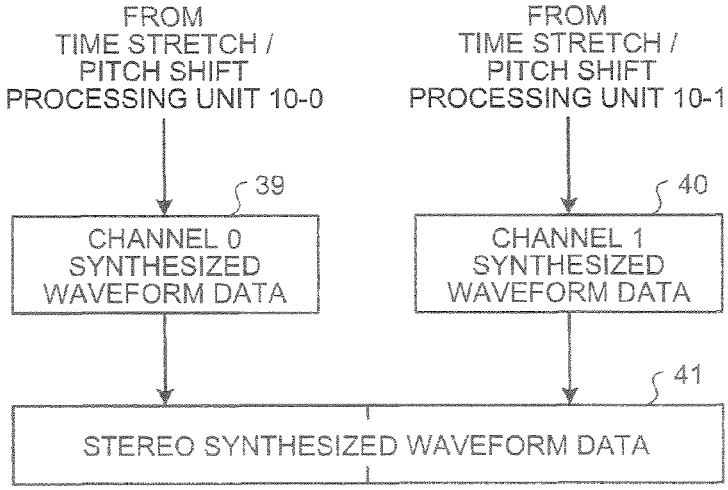
FIG. 15 is a diagram for describing details of a channel integration processing unit.

Furthermore, the channel integration processing unit 11 renders the waveforms synthesized per channel by the time stretch/pitch shift processing units 10 stereo so as to have the same number of channels as the audio input waveforms. FIG. 15 shows a data flow of the channel integration processing unit 11. The waveforms stored in a channel 0 synthesized waveform memory 39 and a channel 1 synthesized waveform memory 40 are rearranged in one bundle in a stereo synthesized waveform memory 41. In this case, it is also possible to hold initial addresses of the channel 0 synthesized waveform memory 39 and the channel 1 synthesized waveform memory 40 in the stereo synthesized waveform memory 41 and refer to their respective memory addresses to handle them as stereo waveform data. The stereo-rendered audio waveforms after the band component synthesis are further processed by the phase synchronization processing unit 5.

Figure 3:
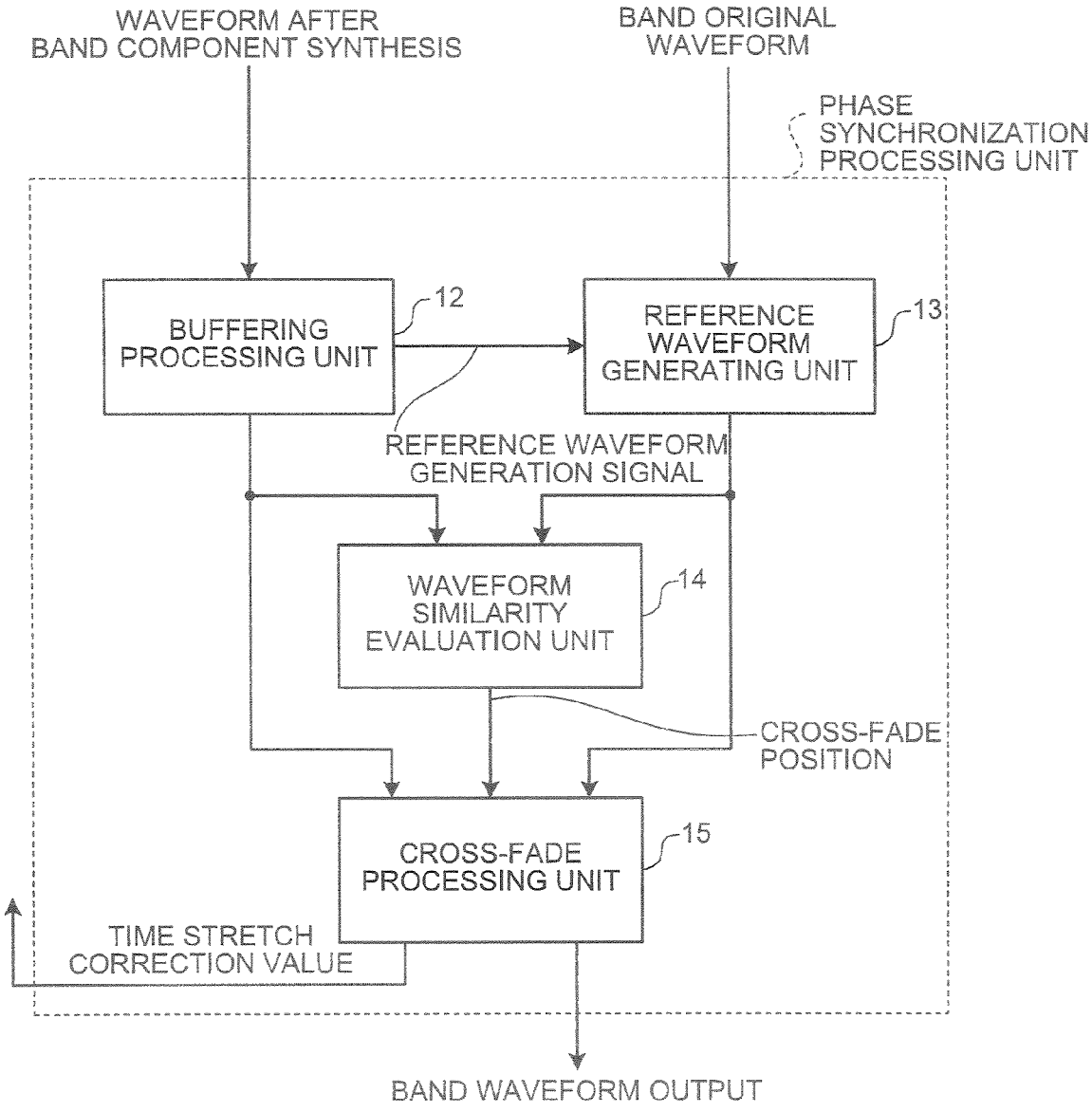
FIG. 3 is a block diagram for describing details of a phase synchronization processing unit.

FIG. 3 shows details of the phase synchronization processing unit 5 of FIG. 1 in a block diagram. The waveform for one frame generated by the band component synthesizing unit 4 of FIG. 1 is once accumulated in a buffering processing unit 12 of FIG. 3. This is because the phase synchronization processing requires the waveform of a certain length, and there are the cases where the length of one frame is not sufficient.

The number of frames necessary for the phase synchronization processing is different as to each of the bands having undergone frequency band division. Evaluation of similarity in the phase synchronization processing described later requires periodic components included in the synthesized waveforms equivalent to several waveforms. And the length of the waveform necessary for that purpose is long as to a low-frequency band and short as to a high-frequency band.

If the number of frames is taken too long, intervals of the phase synchronization processing become wider so that the phase change becomes great enough to cause an auditory sense of discomfort due to the phase change to be perceived. It is desirable to use an adequate number of frames by considering the frequency band and auditory quality of the band. If the number of frames is within 40 msec as a time length, the discomfort due to the phase change is not so perceivable. As a wavelength becomes long on the low-frequency band, however, the number of frames of over 40 msec including the waveforms of five wavelengths or so is used.

If the waveforms of the length necessary for the phase synchronization processing are accumulated in the buffering processing unit 12 of FIG. 3, the waveforms are outputted and the buffer is cleared. At the same time, a reference waveform generation signal is outputted, and a reference waveform generating unit 13 generates a reference waveform for the phase synchronization processing from the band original waveform divided by the frequency band dividing unit 2. FIG.

Figure 16:
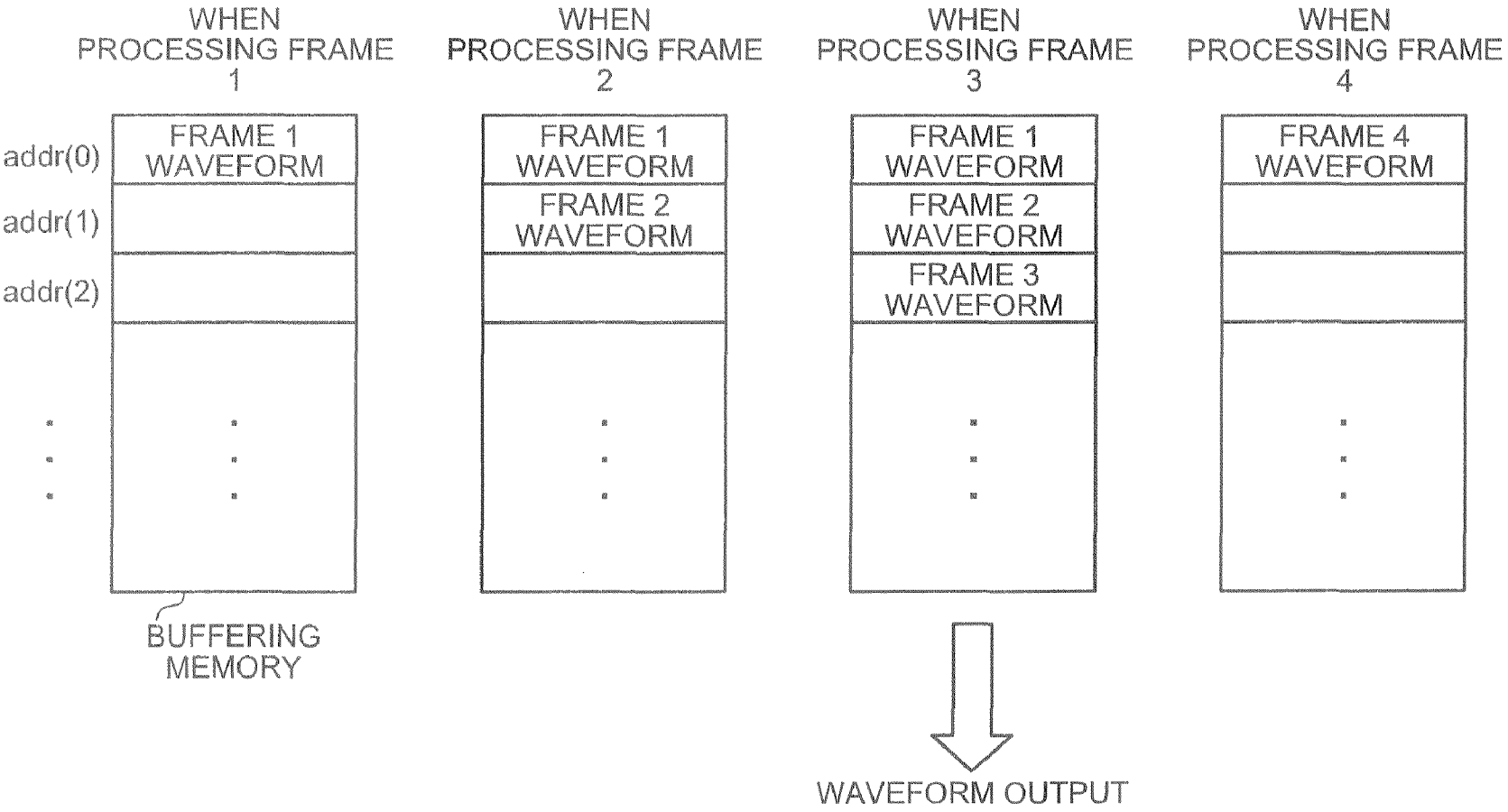
FIG. 16 is a diagram for describing memory usage of a buffering processing unit.

16 shows memory usage of the buffering processing unit. In FIG. 16, it is presumed that the length of the waveform necessary for the phase synchronization processing is 3 frames, the waveforms are outputted if the band synthesized waveforms equivalent to 3 frames are accumulated, and the synthesized waveform of the fourth frame is placed at a head of a buffering memory.

Figure 4A:
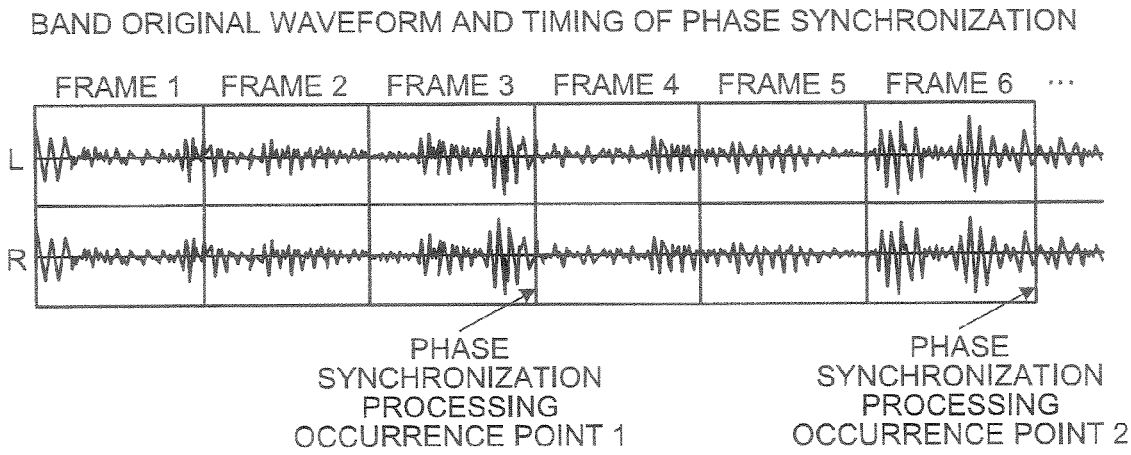
FIGS. 4A, 4B and 4C are diagrams for describing a reference waveform generation.
Figure 4B:
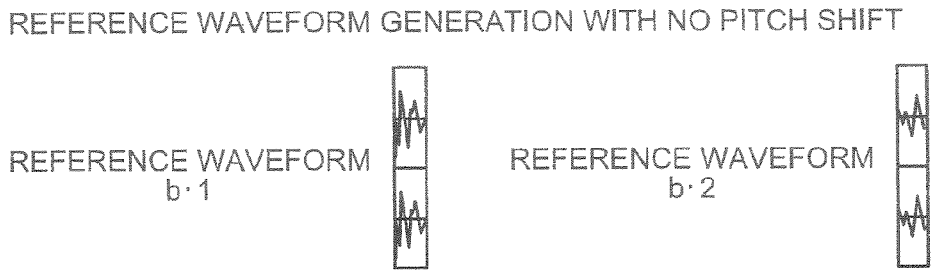

A manner of generating the reference waveforms will be described with reference to FIGS. 4A to 4C. In this example, it is presumed that the phase synchronization processing is performed at every 3 frames. FIG. 4A shows how the band original waveforms correspond to the frames, where the phase synchronization processing occurs after the processing of the frame 3 and the frame 6. In FIG. 4A, the waveforms are drawn in two tiered stages, and the respective channels of a stereo audio waveform are dividedly drawn. FIG. 4B shows the reference waveforms in the respective phase synchronization processing in the case where there is no pitch shift. These waveforms are parts of final frames of a section before execution of the phase synchronization processing, that is, ends of the frame 3 and the frame 6 in FIG. 4A cut out as-is.

Figure 4C:
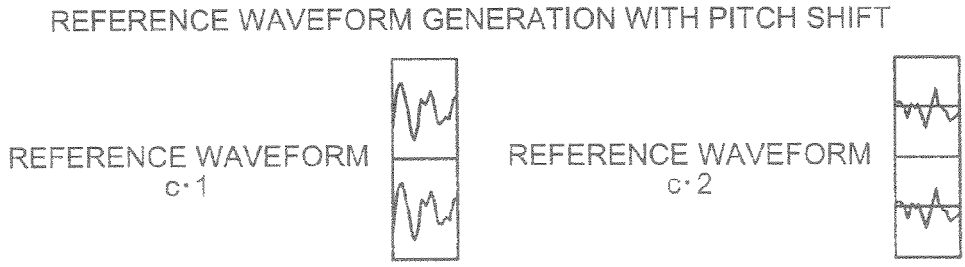

FIG. 4C shows the reference waveforms in the case where there is the pitch shift. Here, an example of the case of pitch-shifting to ½ is shown. As in FIG. 4C, the waveforms of FIG. 4B are simply scaled against the time axis, and an expansion rate of the time axis is $1/\alpha$ if the value of frequency scaling of the pitch-shift is $\alpha$.

Figure 17:
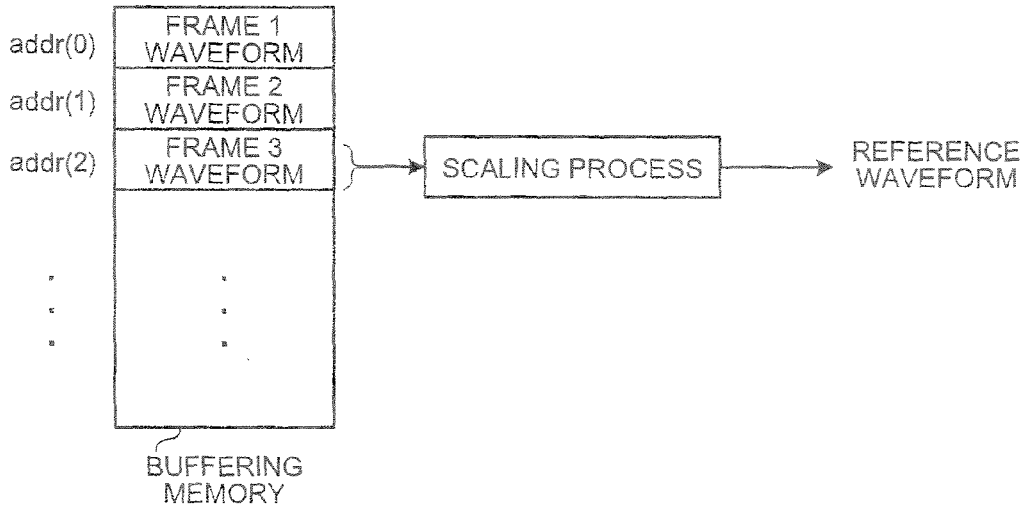
FIG. 17 is a diagram for describing a data flow of reference waveform generation.

An adequate length of the reference waveform is the length including the periodic components equivalent to one to two wavelengths. If it is too long or too short, a good result cannot be obtained in the evaluation of similarity subsequently described. The pitch shift processing on reference waveform generation is only a simple scaling of the time axis. The pitch shift by the scaling of the time axis usually has a problem that the length of the waveforms changes. As for the reference waveform, however, there is no such problem because it is only used for the evaluation of similarity and a cross-fade process. FIG. 17 shows the data flow of the reference waveform generation unit 13 of FIG. 3. Of the waveform data stored in the buffering memory, the waveform data is read from the address of the end of the third frame, and the scaling of the time axis is performed according to the pitch shift amount so as to output the reference waveform.

Figure 18:
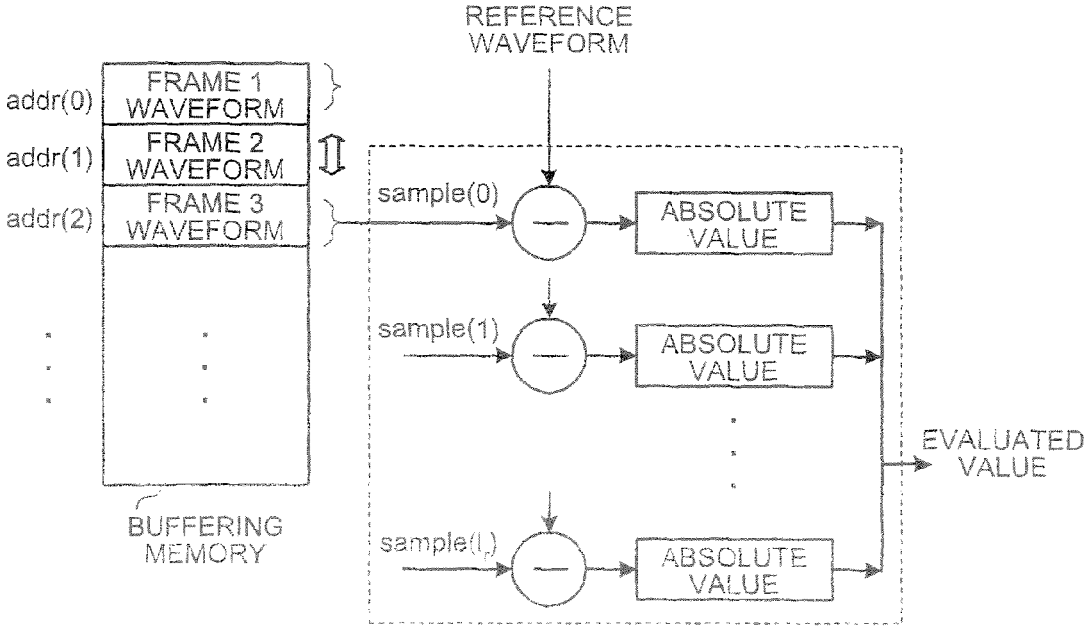
FIG. 18 is a block diagram for describing details of evaluation of a waveform similarity evaluation unit.

Next, a waveform similarity evaluation unit 14 of FIG. 3 evaluates at what time point on the time axis the similarity of two waveforms is high by using the waveform accumulated in the buffering processing unit 12 and the waveform generated by the reference waveform generation unit 13. The location of high similarity acquired here is used as a cross-fade position in the subsequent cross-fade process. To acquire this, an arbitrary evaluation function for evaluating similarity is prepared, and the evaluation function is executed for the buffered band synthesized waveform while shifting the time axis so as to acquire the time point of the highest evaluated value as a result. As an example of the evaluation function, an absolute value of a difference between the band synthesized waveform and the reference waveform is calculated at each sample point to use a result of adding them up as the evaluated value. FIG. 18 specifically describes this evaluation method. In FIG. 18, the number of sample points of the reference waveform is $l_r$. A part of the waveform data stored in the buffer is taken out, and the absolute value of the difference from the reference waveform is calculated as to all the n pieces of sample point to acquire the sum thereof as the evaluated value. The waveform is cut out by shifting the address of the buffering memory, and the evaluated value is calculated as to the entire waveform data. Of the evaluated values thus calculated, it can be said that a smaller value indicates a smaller difference in the waveform and higher similarity.

Next, the cross-fade process is performed to return from the band synthesized waveform buffered by a cross-fade processing unit 15 to the reference waveform by using the waveform generated by the reference waveform generation unit 13 and the cross-fade position calculated by the waveform similarity evaluation unit 14.

Figure 5:
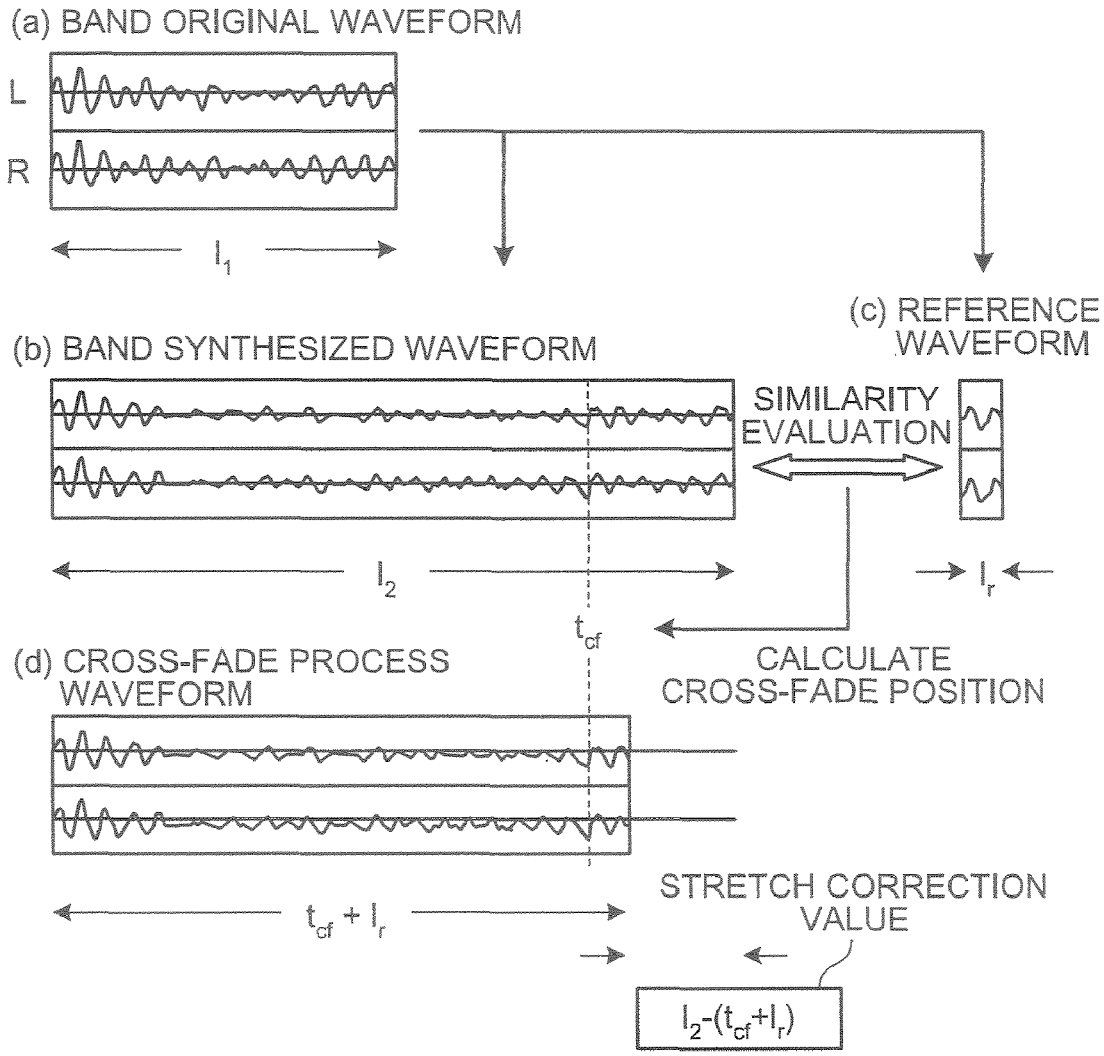
FIG. 5 is a diagram for describing a concept of phase synchronization processing.

A description will be given as to the concept of the phase synchronization processing described so far with reference to an example shown in FIG. 5. In FIG. 5 two channels of the stereo audio waveform are dividedly drawn in two tiered stages, which indicates that the reference waveform generation, similarity evaluation, and cross-fade process are performed in stereo.

A portion (a) of FIG. 5 shows the band original waveform which is presumed undergoing twice time-stretching. In this case, the length of the band original waveform of the portion (a) of FIG. 5 is $l_1$.

According to the processing described so far, a band synthesized waveform (b) of FIG. 5 stretched to twice and accumulated in the buffering processing unit 12 of FIG. 3 and a reference waveform (c) of FIG. 5 generated by the reference waveform generation unit 13 are obtained respectively. In this case, it is defined that the length of the band synthesized waveform (b) in FIG. 5 is $l_2$ ($=l_1\times 2$), and the length of the reference waveform (c) in FIG. 5 is $l_r$. The similarity of these waveforms is evaluated by the similarity evaluation unit 14 of FIG. 3, and the calculated cross-fade position of FIG. 5 is $t_{cf}$.

The cross-fade process of FIG. 5 is performed in the range of the length corresponding to the reference wave form from the calculated cross-fade position $t_{cf}$, that is, the section from $t_{cf}$ to $t_{cf}+l_r$. A portion (d) in FIG. 5 shows the waveform after the cross-fade process. As is understandable from (d) in FIG. 5, the end of the waveform after finishing the cross-fade process has the same value as the end of the reference waveform. To be more specifics it returns to the same phase condition (is phase-synchronized) as the band original waveform. Even if the audio input waveform is stereo the phase relation between the channels is kept by the processing. This portion deserves special mention in the present invention.

Figure 19:
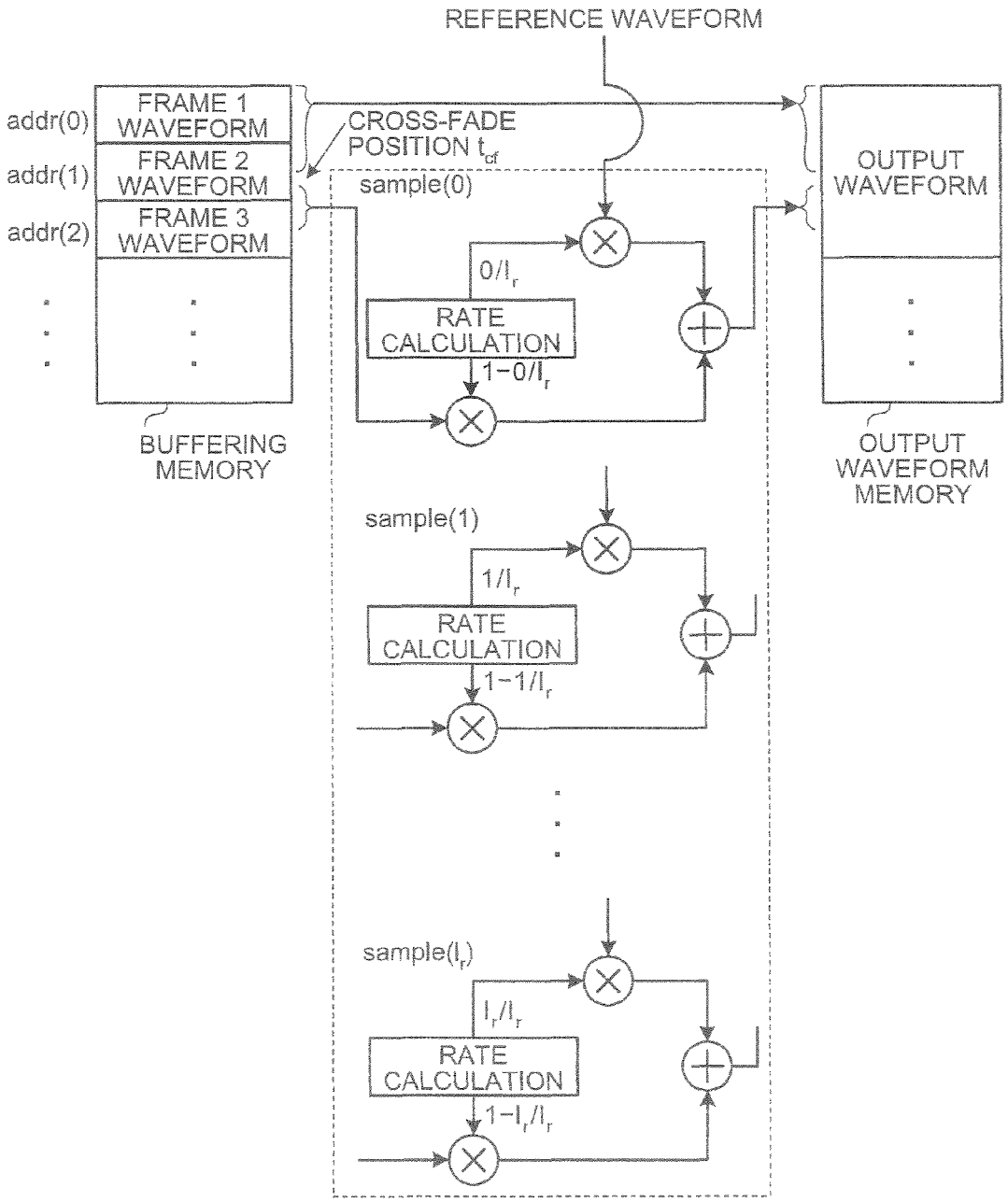
FIG. 19 is a block diagram for describing details of a cross-fade process.

FIG. 19 shows details of the cross-fade process. In FIG. 19, it is presumed that the length of the waveform necessary for the phase synchronization processing is equivalent to three frames. The waveforms from the cross-fade position $t_{cf}$ onward accumulated in the buffering memory undergo rate calculation and multiplication as to each sample point. At the same time, the reference waveform undergoes the rate calculation and multiplication so as to output the sum of the values after the multiplication. The rate calculations in FIG. 19 indicate an example of cross-fades by linear interpolation. The waveforms prior to the cross-fade position $t_{cf}$ are stored as-is as the output waveforms in an output waveform memory.

The waveform after finishing the cross-fade process becomes a band output waveform as-is. However, the length thereof is $t_{cf}+l_r$ which is shorter than the length $l_2$ of an original stretched waveform. As the portion equivalent to the length of $l_2-(t_{cf}+l_r)$ remaining after $t_{cf}+l_r$ is discarded, that length occurs as an error in the phase synchronization processing. To correct this, the value of the error is passed as a stretch correction value to a time stretch amount correction processing unit 7 in the band component synthesizing unit of FIG. 2. As a result thereof, the waveform synthesis is performed by adding the length of the error in the next frame so as to keep the length of the original waveform.

If the error due to the phase synchronization processing is large, there is an increase in the discarded amount of the waveforms generated by the band component synthesizing units 4 of FIG. 1, which leads to lowering of processing efficiency. To prevent this, it is necessary to lessen the error. As one of the means for solving this, there is a thinkable device, such as inclining the evaluation function of the waveform similarity evaluation unit 14 of FIG. 3 to heighten the evaluated value as the position goes backward.

The above process is performed to each of the bands so as to acquire a final audio output waveform by adding them.

Figure 6:
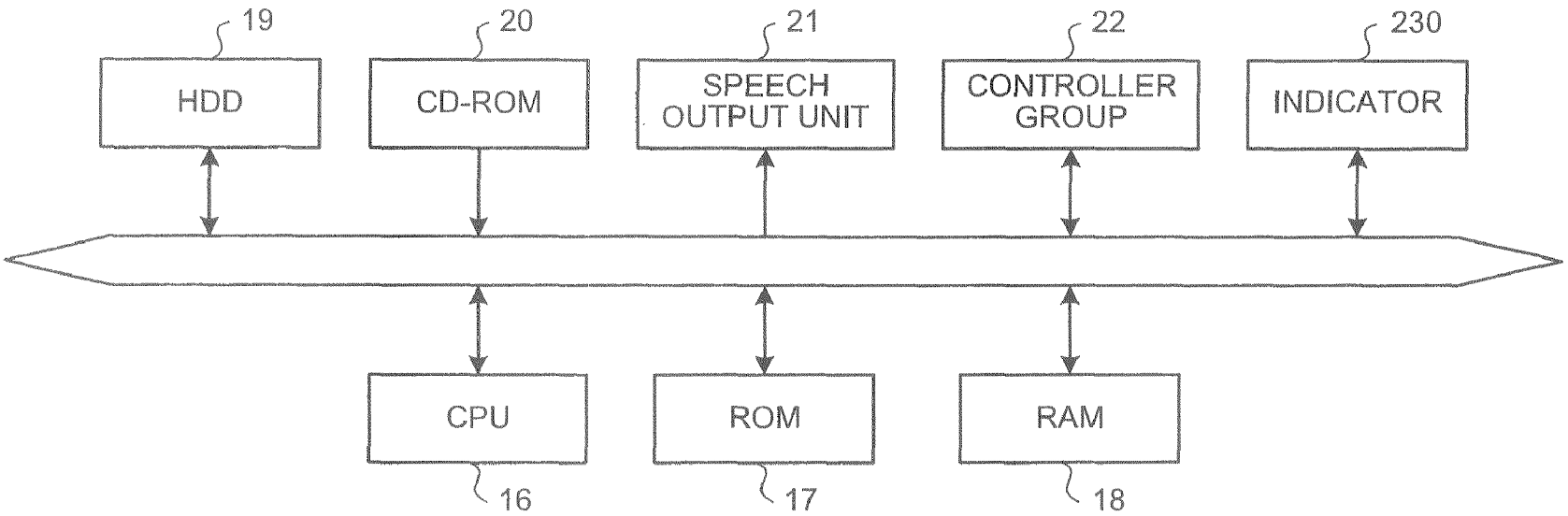
FIG. 6 is a diagram showing an audio signal processing device as an embodiment according to the present invention.
Figure 7A:
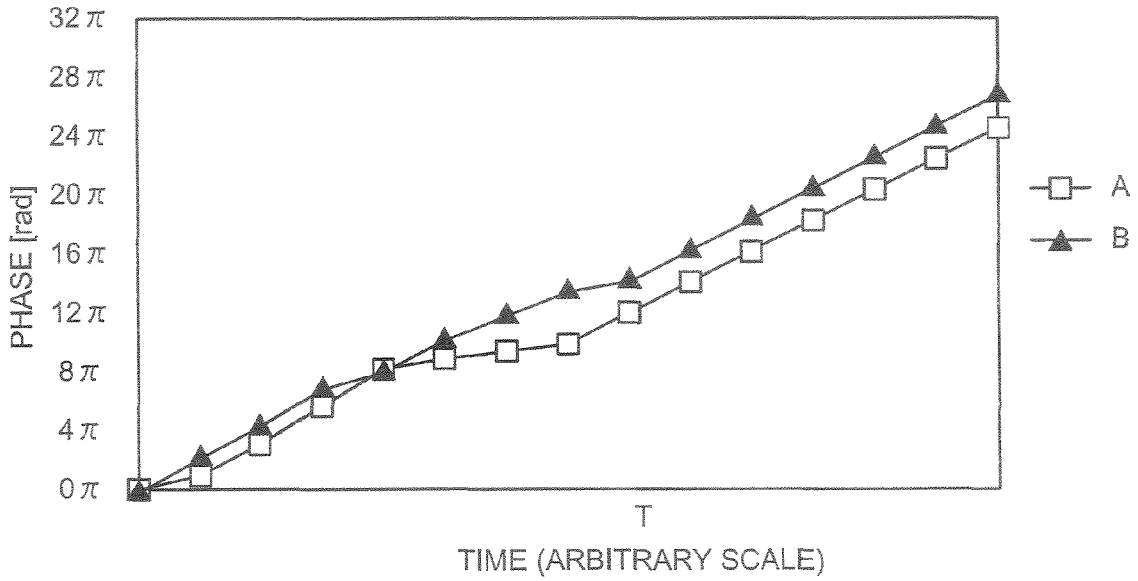
FIGS. 7A and 7B are diagrams for describing an appearance of a phase change according to a conventional vocoder method.
Figure 7B:
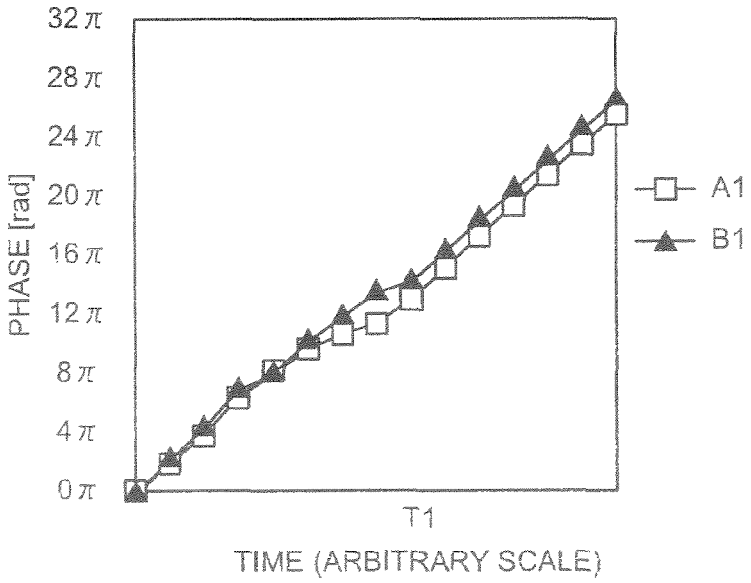
Figure 8A:
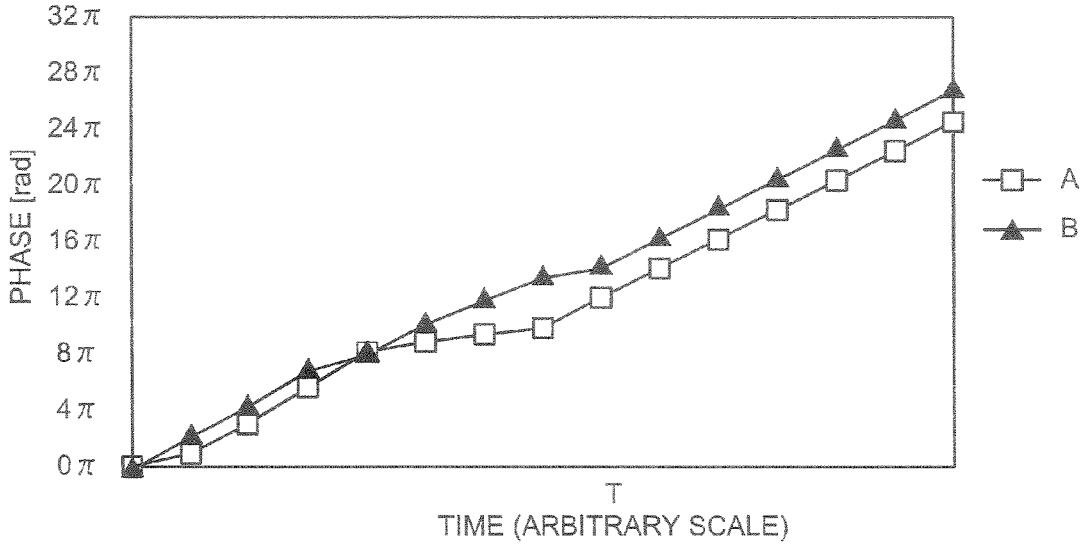
FIGS. 8A and 8B are diagrams for describing effects of the phase synchronization processing according to the present invention.
Figure 8B:
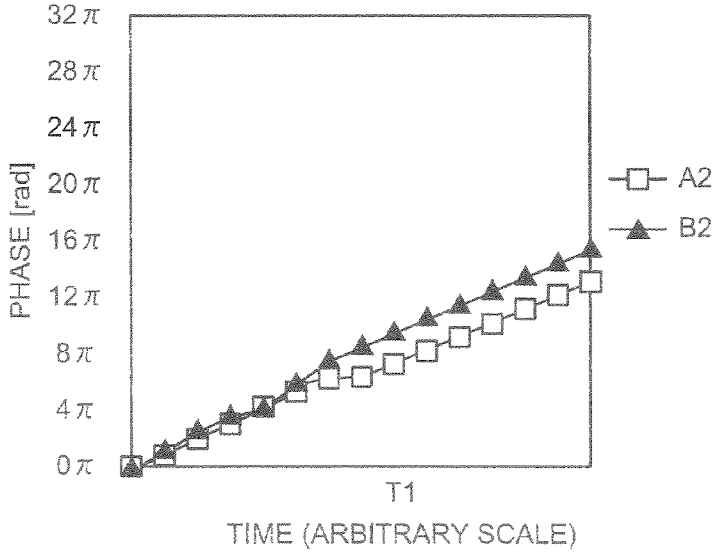

Next, an audio signal processing apparatus of the present invention will be described. FIG. 6 shows an audio signal waveform processing device as an embodiment according to the present invention. This example reproduces and outputs the audio waveform on recording media such as a hard disk drive 19 and a D-ROM drive 20 while performing the time stretching and pitch shifting. The present invention, however, is not limited to this example, and the audio signal processing apparatus of the present invention can be mounted on various instruments, such as a sampler and an electronic musical instrument.

In FIG. 6, a CPU 16 is a central processing unit for exerting overall control of the device, a ROM 17 is a read-only memory storing a control program, and a RAM 18 is a random access memory utilized as a memory work area and the like. The hard disk drive 19 and the CD-ROM drive 20 are external storage devices which are used as inputs of the audio waveforms. A speech output unit 11 is composed of a D/A converter for converting a digital audio waveform to analog and a speaker. A controller group 22 is various switches and the like. An indicator 230 is an indicator used to display parameters on the screen when selecting the time stretch/pitch shift amount.

A program composed of an instruction group for causing a computer to execute an audio signal processing method of the present invention is stored in the ROM 17. The CPU 16 performs waveform processing to the audio waveforms of the hard disk drive 19 and the CD-ROM drive 20 while using the RAM 18 as a working memory, and the result is outputted as sound from the speaker of the speech output unit 21. It is possible, with the above configuration, to realize an audio reproducing device which performs the time stretch/pitch shift processing of high quality to music recorded on a hard disk and a CD-ROM.

Second Embodiment

The first embodiment has described the example of implementing the waveform processing by performing the band division on the audio input waveform. It is possible, however, to implement the same waveform processing as that described in the first embodiment by following structures which do not perform the band division on the audio input waveform. In FIG. 1, the frequency band dividing unit 2, the band component synthesizing unit (band 1) 4-1 to the band component synthesizing unit (band 5) 4-5, and the phase synchronization processing unit (band 1) 5-1 to the phase synchronization processing unit (band 5) 5-5 are deleted, and the audio input waveform 1 is directly inputted to the band component synthesizing unit (band 0) 4-0 and perform the same waveform processing as that described in the first embodiment.

Third Embodiment

Figure 20:
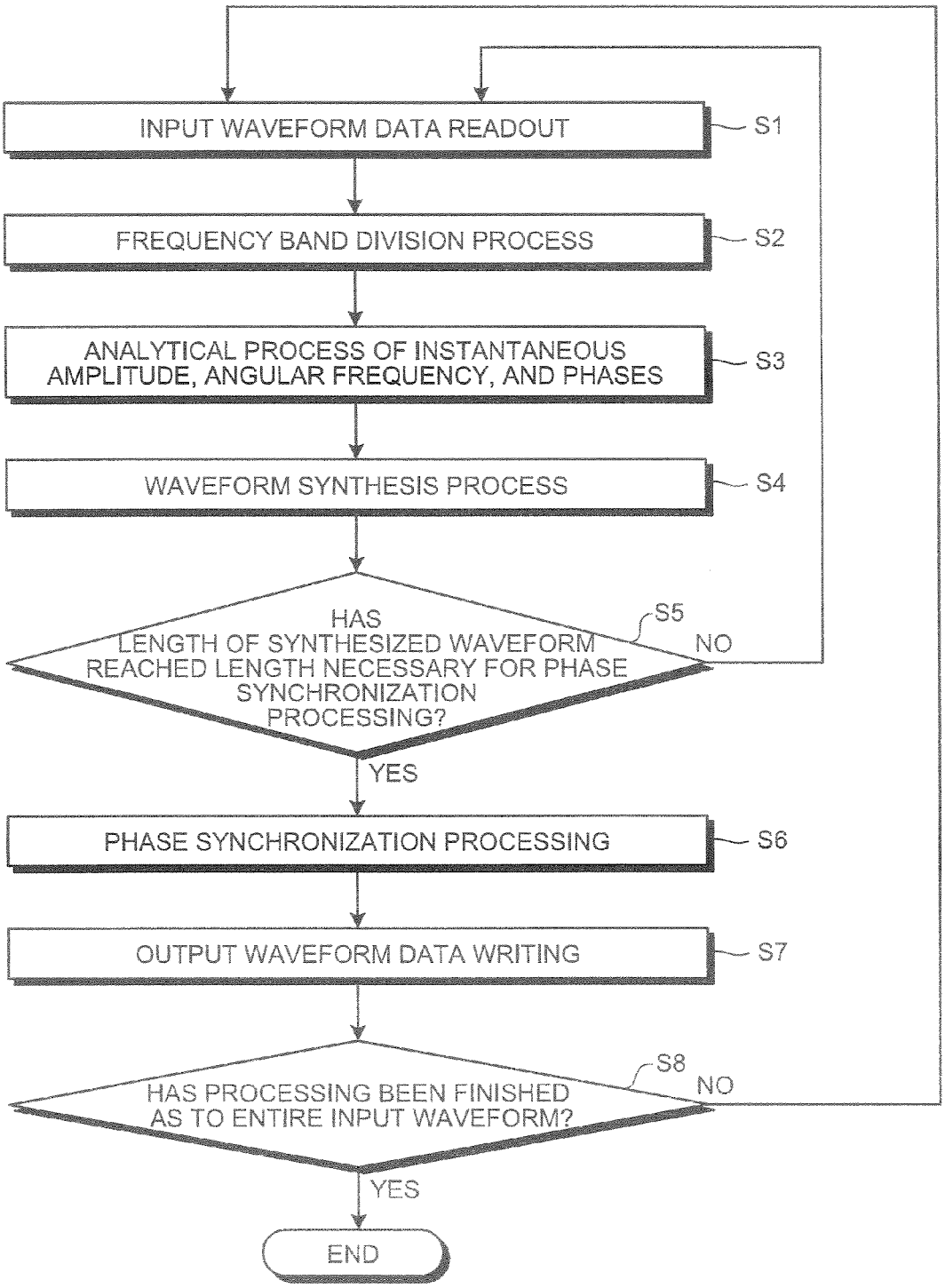
FIG. 20 is a flowchart for describing a computer program of the present invention.

Next, a computer program that is a third embodiment and causes the above-mentioned structure/method of the first and the second embodiments to be performed will be described. FIG. 20 shows a flowchart of the computer program. First, input waveform data is read (step S1), and a frequency band dividing process (step S2) which is the same as the frequency band dividing unit 2 of FIG. 1 is performed so as to output the waveform of each band. This process is composed of an instruction group such as multiplications and additions for realizing the band-pass filter or an instruction group for executing FFT in the case of realizing the band division by Fourier transform.

Next, an analytical process is performed as to instantaneous amplitude, angular frequency, and phases of band waveform data having undergone the frequency band division (step S3). This process is a part equivalent to the frequency analysis units 9-0 to 9-1 of FIG. 2, and is composed of the instruction group for executing the FET and instruction groups of square roots for calculating the amplitude, arctans for calculating the phases, and the like.

A waveform synthesis process (step S4) is executed based on the analyzed data. This process is the same process as that of the time stretch/pitch shift processing units 10-0 to 10-1 of FIG. 2. It is composed of instruction groups such as cosine functions for playing a role of an oscillator and multiplications for multiplying the amplitudes, where a time stretched and/or pitch-shifted waveform is synthesized.

Next, it is determined whether or not the length of the synthesized waveform has reached the length necessary for the phase synchronization processing (step S5). In the case where the necessary length has not been reached, the procedure returns to the step S1 to repeat the process until the necessary length is reached while accumulating the synthesized waveforms in the memory. In the case where the necessary length has been reached, the procedure moves on to the next step. This process is the same process as that of the buffering processing unit 12 of FIG. 3

The phase synchronization processing (step S6) is performed to the synthesized waveform. This processing is equivalent to the processing of the reference waveform generation unit 13, the waveform similarity evaluation unit 14, and the cross-fade processing unit 15 of FIG. 3. This processing is composed of an instruction group of subtractions for executing the evaluation function of similarity and the like and an instruction group of multiplications and additions for performing the cross-fade process.

The processing of the step S2 to the step S6 is performed as to each of the bands having undergone the band division, and output waveform data of each band is added up to execute output waveform data writing (step S7). An instruction of addition is used to add up the output waveform data of the bands. Next, it is determined whether or not the processing has been finished as to the entire input waveform (step S8). If the processing has not been finished, the procedure returns to the step S1 to repeat the processing. If the processing has been finished as to the entire input waveform, the processing is finished.

Fourth Embodiment

Figure 9:
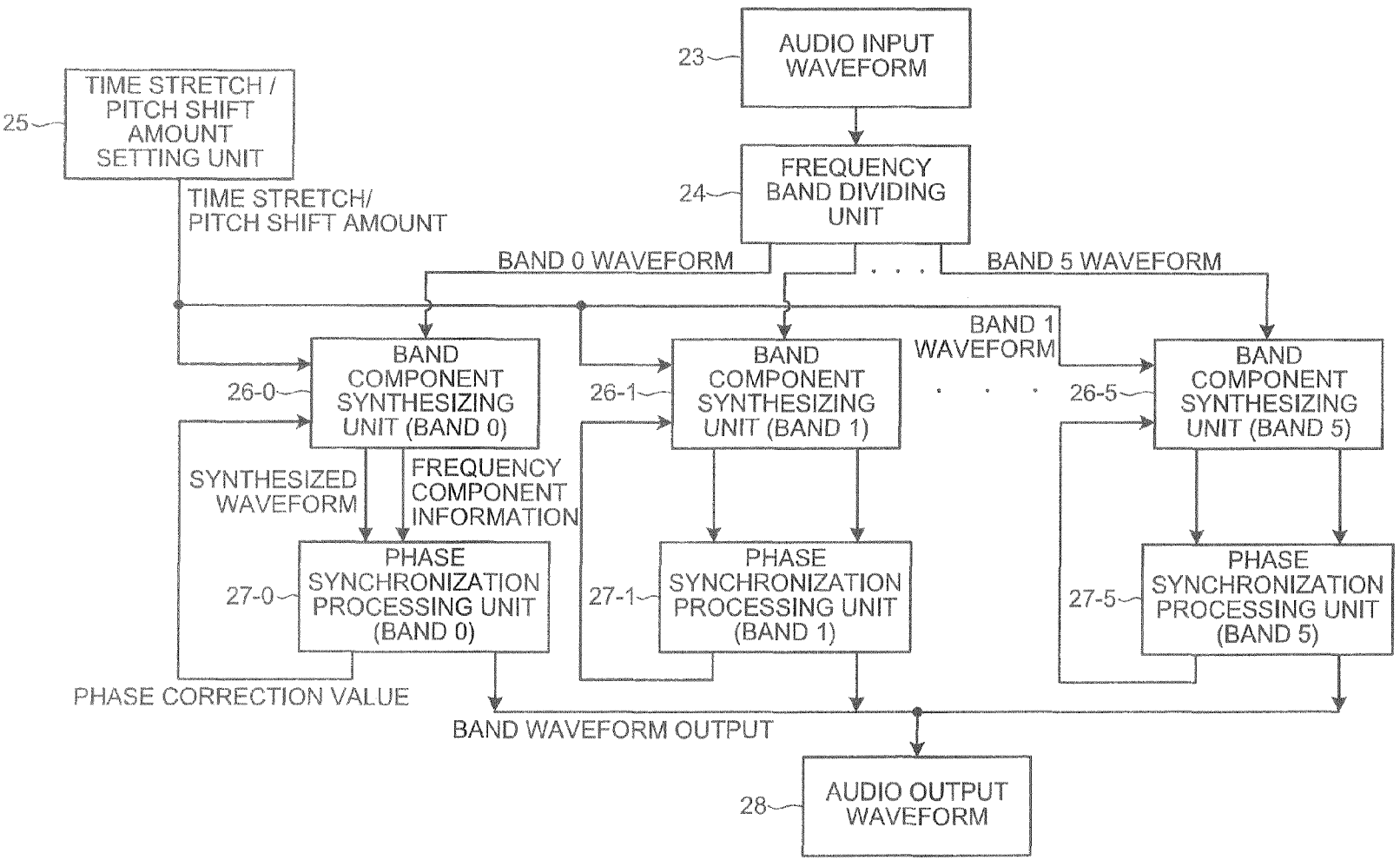
FIG. 9 is a block diagram showing a waveform processing flow according to the present invention.

Next, a fourth embodiment of the present invention will be described. FIG. 9 shows a block diagram of audio waveform processing as a fourth embodiment. The audio waveform handled in this embodiment is digitized.

An audio input waveform 23 is divided into several bands by a frequency band dividing unit 24. The audio input waveform 23 is divided into six bands in this embodiment. Reference numeral 25 denotes a time stretch/pitch shift amount setting unit, where a parameter is changed by an operation by the user. Band waveforms generated by the frequency band dividing unit 24 undergo a frequency analysis by band component synthesizing units 26-0 to 26-5, and the waveforms are synthesized according to a time stretch/pitch shift amount set based on a result of the analysis while the time expansion/compression and the pitch conversion are performed.

Next, phase synchronization processing units 27-0 to 27-5 perform the phase synchronization processing by using the waveforms synthesized by the band component synthesizing units 26 and frequency component information. An audio output waveform 28 is a result of additively synthesizing output waveforms of the phase synchronization processing units 27 of respective bands. As the phase condition of the synthesized waveform is a linear phase lead or a linear phase lag of the original waveform in the phase synchronization processing unit 27, a phase correction value is fed back to the band component synthesizing units 26 so as to correct a phase value to be applied on the next synthesis process.

It is desirable to set the number of bands to be divided by the frequency band dividing unit 24 and the bands thereof in accordance with the audio input waveform. There are the cases where it is no, necessary to divide a simple audio signal such as performance of a single instrument. Inversely, the number of divisions must be increased as to a complicatedly mixed tune. As shown in the block diagram, the phase synchronization processing is performed on a per-band basis so that the phase change in the band is reduced. However, there is a possibility that the phase relation among the bands may collapse. For that reason, it is necessary to use an adequate number of divisions and bands which are not too many. The audio input waveform such as music can be adequately processed when divided into a bandwidth which is one octave or so as a music scale.

Figure 10:
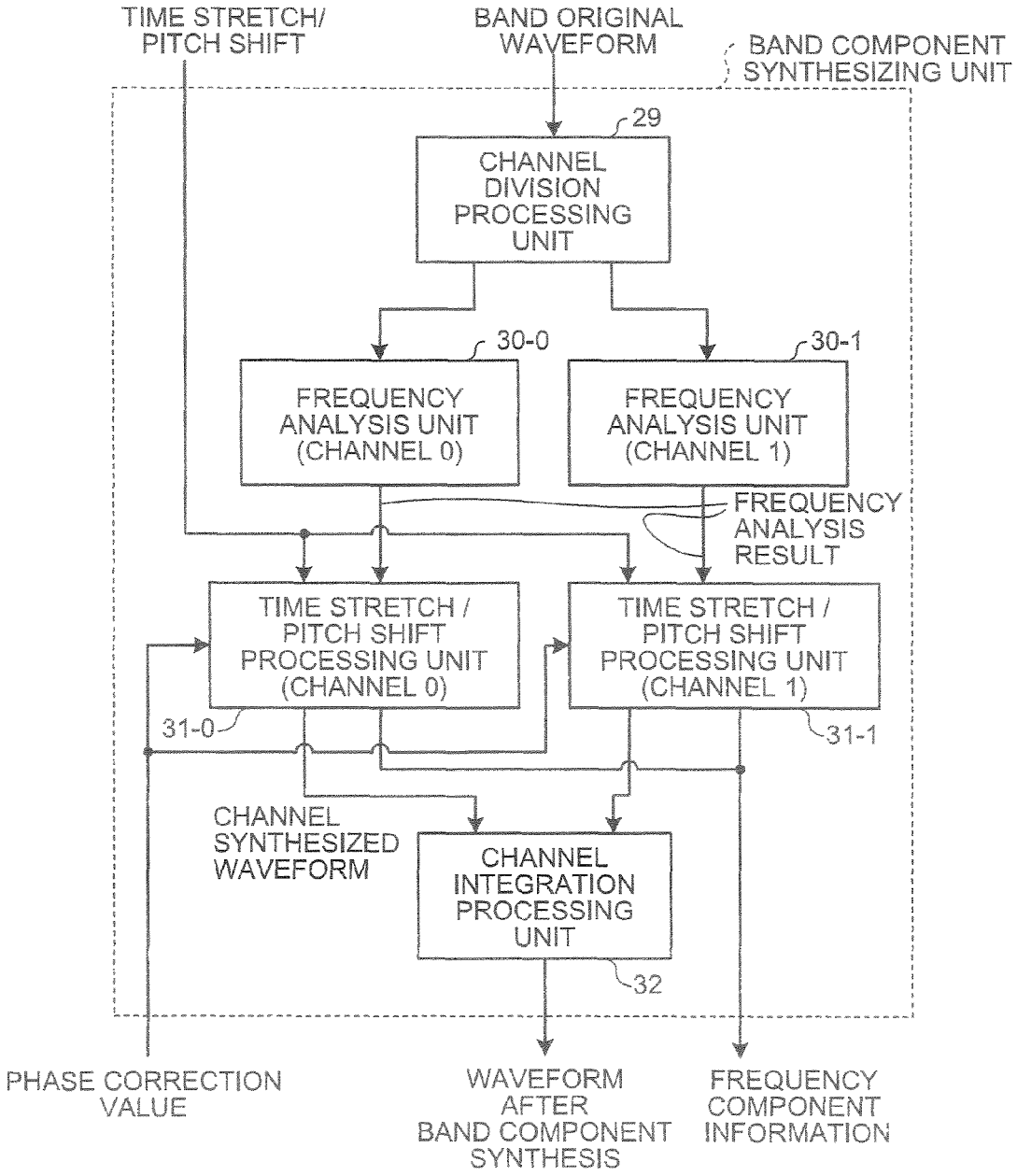
FIG. 10 is a block diagram for describing details of the band component synthesizing unit.

FIG. 10 shows details of the band component synthesizing unit 26 of FIG. 9 in a block diagram. Here, it is presumed that a stereo 2-channel audio waveform is processed. A channel division processing unit 29 divides the band waveform generated by the frequency band dividing unit 24 into channels. The number of divisions in this case is different according to the number of channels of the audio input waveform. The frequency analysis and the time stretch/pitch shift processing thereafter are performed as to each of the divided channels.

Figure 21:
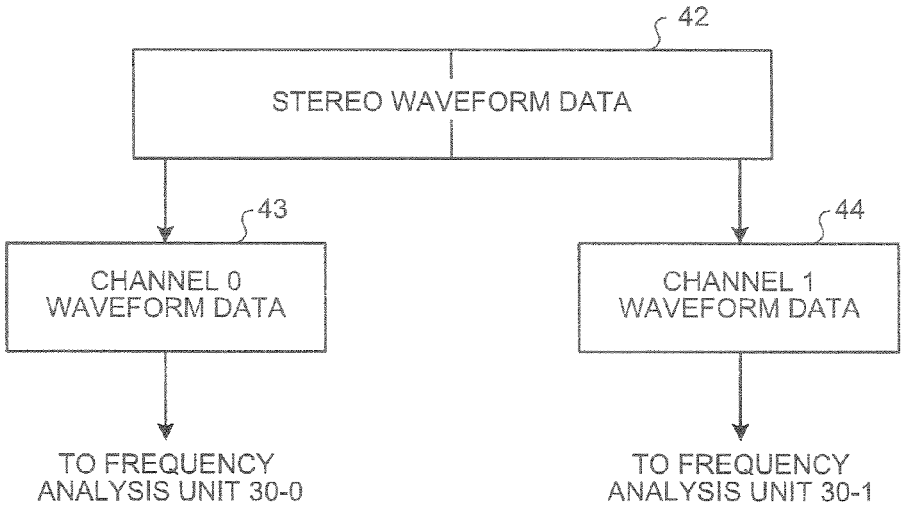
FIG. 21 is a diagram for describing details of a channel division processing unit.

FIG. 21 shows a waveform data flow of the channel division processing unit 29 of FIG. 10. A stereo waveform memory 42 has waveform data of two channels placed in one bundle therein, and the data of each channel is rearranged in a channel 0 waveform memory 43 and a channel 1 waveform memory 44 and is passed to frequency analysis units 30-0 to 30-1. In this case, the same process is also possible by passing an initial address of each channel in the waveform memory 42 to the frequency analysis units 30-0 to 30-1 instead of rearranging the data.

Next, the frequency analysis units 30-0 to 30-1 of FIG. 10 calculate frequencies, phases, and amplitudes included in the waveforms divided by the channel division processing unit 29 by using the STFFT (Short-Time Fast Fourier Transform). The length of the audio waveform analyzable by the STFFT at one time is decided by a window function to be used and an FFT size. This length is defined as one frame, and a waveform synthesis subsequently described is performed frame by frame. For instance, in the case of processing a digital audio waveform discretized at 44.1 kHz, 1024 points are used as the window function and FFT size. Thus, a width on the time axis is approximately 23.2 msec, and the data per approximately 43 Hz is acquired on a frequency axis with a good balance between a frequency resolution and a time resolution. In the case of rendering the frequency resolution higher than this, the FFT size is rendered larger. In the case of rendering the time resolution higher, the FFT size is rendered smaller. Square root and arctangent operations are performed from the data calculated by the FFT. As shown in FIG. 13, the data on an amplitude AS/AE, a phase PS/PE and an instantaneous angular frequency W of the frequency component is stored in a memory address. It is adequate that the bandwidth of one frequency component is one halftone or so as the music scale. In the case where the bands are divided into 1-octave bandwidths by the frequency band dividing unit 2, twelve pieces of frequency component data are calculated.

Figure 22:
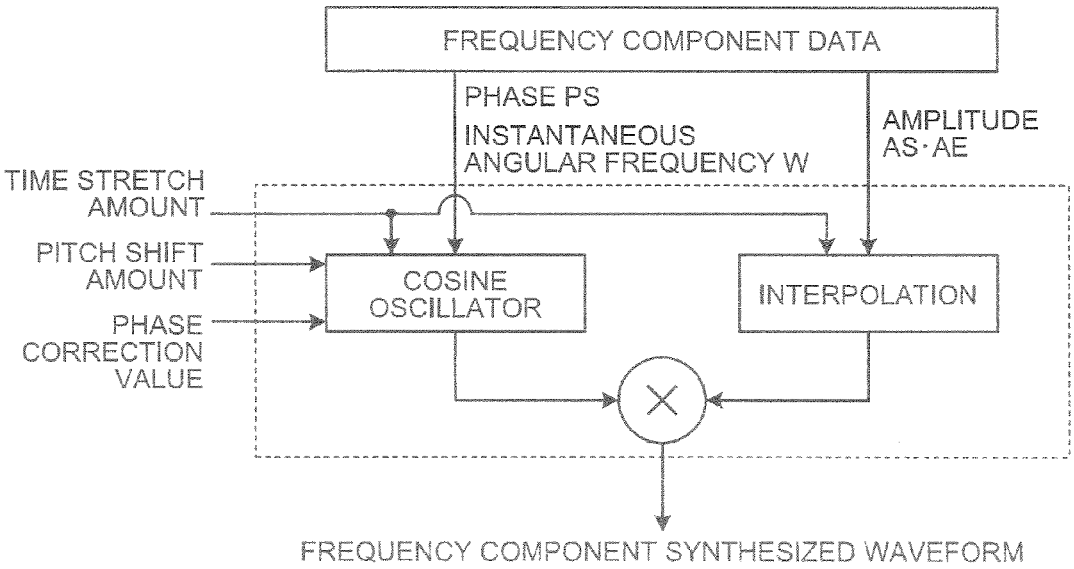
FIG. 22 is a diagram for describing the time stretch and pitch shift processing.

Next, time stretch/pitch shift processing units 31-0 to 31-1 of FIG. 10 synthesize the waveforms according to the result analyzed by the frequency analysis units 30 and the required time stretch/pitch shift amounts. Sine or cosine oscillation is performed for each frequency component and those are additively synthesized to acquire a synthesized waveform the time axis for synthesizing the waveform is compressed or expanded according to the time stretch amount required in this case. Amplitude values are interpolated so that the amplitudes will not be discontinuous due to the compression or expansion of the time axis. The angular frequency of oscillation is scaled according to the required pitch shift amount. As for the phase when starting the oscillation, the phase calculated by the frequency analysis units 30 of FIG. 10 is set on an initial operation. In other cases in a state where the phase correction value is not inputted, the phase on finishing the oscillation of a previous frame is used as-is, and processing is performed so that the waveforms are smoothly connected between the frames. In the case where the phase correction value is inputted, it is the frame after performing the phase synchronization processing subsequently described. Therefore, the linear phase lead or linear phase lag state of the phase analyzed by the frequency analysis units 30 is calculated based on the phase correction value so as to use it as the phase when starting the oscillation. A configuration of these processes is as shown in FIG. 22. The synthesized waveform data is stored in the memory and passed to a channel integration processing unit 32.

Figure 23:
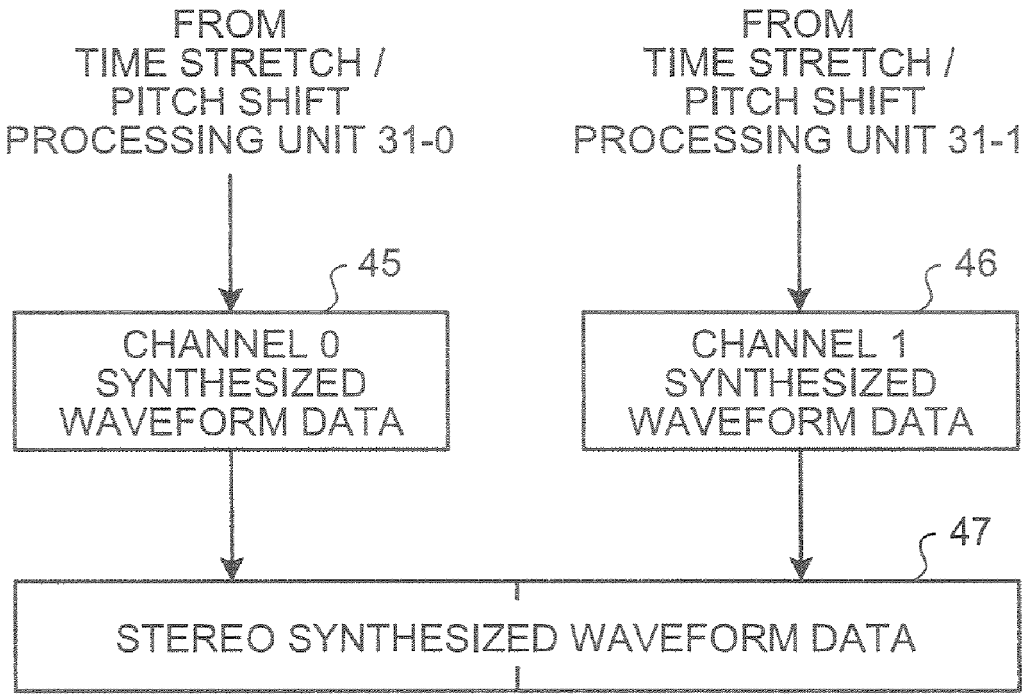
FIG. 23 is a diagram for describing details of the channel integration processing unit.

Furthermore, the channel integration processing unit 32 renders the waveforms synthesized per channel by the time stretch/pitch shift processing units 31 stereo so as to have the same number of channels as the audio input waveforms. FIG. 23 shows a data flow of the channel integration processing unit 31. The waveforms stored in a channel 0 synthesized waveform memory 45 and a channel 1 synthesized waveform memory 46 are rearranged in one bundle in a stereo synthesized waveform memory 47. In this case, it is also possible to hold initial addresses of the channel 0 synthesized waveform memory 45 and the channel 1 synthesized waveform memory 46 in the stereo synthesized waveform memory 47 and refer to their respective memory addresses to handle them as the stereo waveform data. The stereo-rendered audio waveforms after the band component synthesis are further processed by the phase synchronization processing unit 27.

Figure 11:
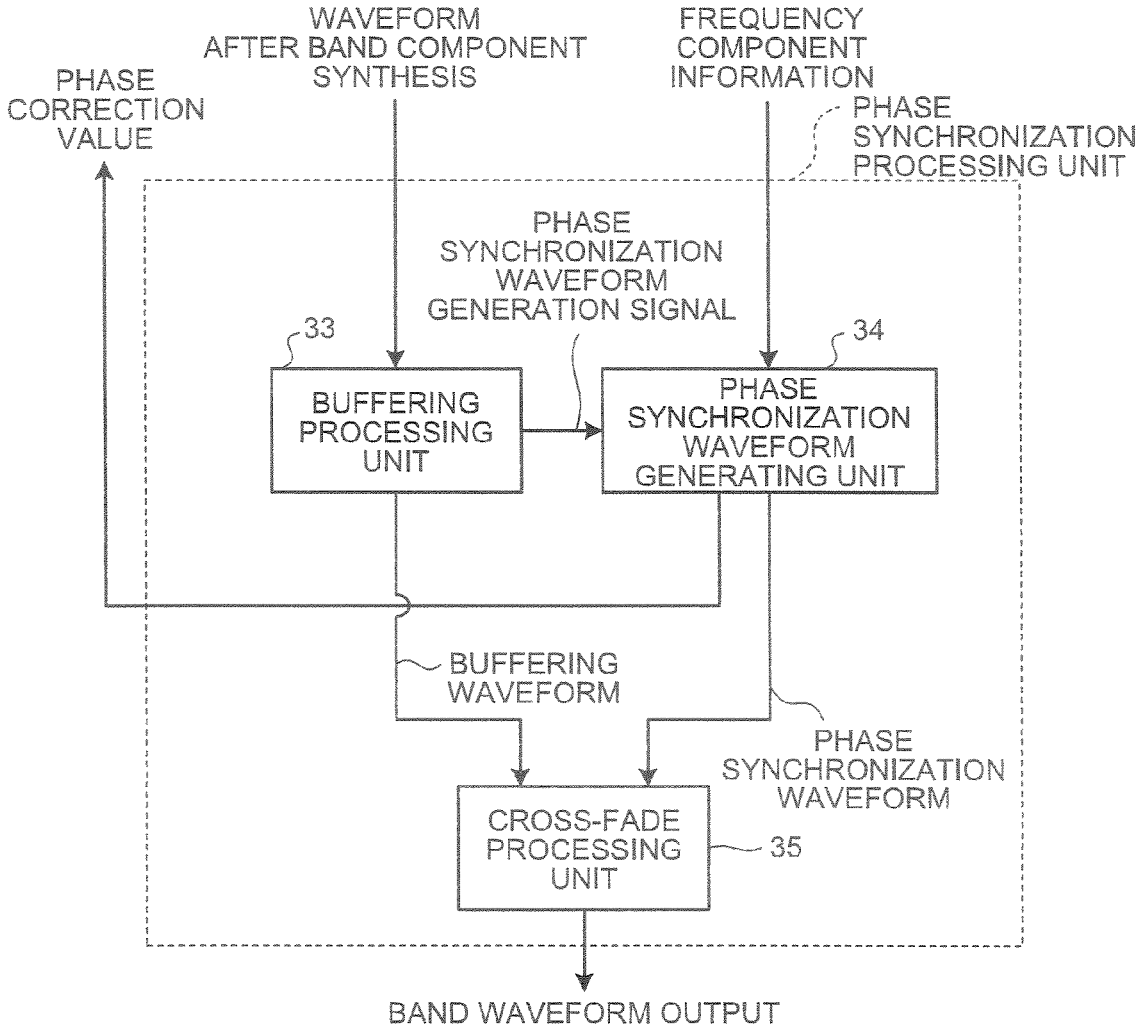
FIG. 11 is a block diagram for describing details of the phase synchronization processing unit.

FIG. 11 shows details of the phase synchronization processing unit 27 of FIG. 9 in a block diagram. The waveform for one frame generated by the band component synthesizing units 26 is once accumulated in a buffering processing unit 33. This is because the phase synchronization processing requires the waveform of a certain length, and there are the cases where the length of one frame is not sufficient.

The number of frames necessary for the phase synchronization processing is different as to each of the bands having undergone frequency band division. Evaluation of similarity in the phase synchronization processing described later requires periodic components included in the synthesized waveforms equivalent to several waveforms. And the length of the waveform necessary for that purpose is long as to a low-frequency band and short as to a high-frequency band.

If the number of frames is taken too longs intervals of the phase synchronization processing become wider so that the phase change becomes great enough to cause the auditory sense of discomfort due to the phase change to be perceived. It is desirable to use an adequate number of frames by considering the frequency band and auditory quality of the band. If the number of frames is within 40 msec as a time length, the discomfort due to the phase change is not so perceivable. As the wavelength becomes long on the low-frequency band, however the number of frames of over 40 msec including the waveforms of five wavelengths or so is used.

If the waveforms of the length necessary for the phase synchronization processing are accumulated in the buffering processing unit 33 of FIG. 11, the waveforms are outputted and the buffer is cleared. FIG. 16 shows memory usage of the buffering processing unit 33. In FIG. 16, it is presumed that the length of the waveform necessary for the phase synchronization processing is 3 frames, the waveforms are outputted if the band synthesized waveforms equivalent to 3 frames are accumulated, and the synthesized waveform of the fourth frame is placed at the head of the buffering memory.

A phase synchronization waveform generation signal is outputted simultaneously with the output of a buffered waveform so that a phase synchronization waveform is generated by a phase synchronization waveform generating unit 34 based on frequency information of the band component synthesizing units 26. The phase synchronization waveform is a waveform which is highly correlated with the phase condition after the waveform synthesis and is also a linear phase lead or a linear phase lag of the phase of the original waveform. As the linear phase lead or the linear phase lag is corresponding to a lead or a lag in a time domain, the phase synchronization waveform is equivalent to the original waveform cut out by shifting the time axis. A cross-fade processing unit 35 of FIG. 11 performs the cross-fade process from the buffered waveform to the phase synchronization waveform so as to allow the phase condition of the original waveform to be kept even if the time stretch/pitch shift processing is performed.

The processing of the phase synchronization waveform generating unit 34 will be described by using a formula. The number of frequency components of all the channels included in the band is n. The amplitudes of the frequency components are $a_0, a_1, \ldots$ to $a_{n-1}$, the phases on finishing the waveform synthesis process are $\theta_0, \theta_1, \ldots \theta_{n-1}$, and the instantaneous angular frequencies are $\omega_0, \omega_1, \ldots \omega_{n-1}$. The phases of the original waveforms on finishing the frame, that is, the phases of the original waveforms on starting the next frame are $\phi_0, \phi_1, \ldots, \phi_{n-1}$. Such frequency component information is calculated by the band component synthesizing units 26 of FIG. 9, and the information recorded on the memory as in FIG. 13 is inputted. To be more specific, $a_0, a_1, \ldots$ to $a_{n-1}$ correspond to the amplitude AE on finishing the frame, $\omega_0, \omega_1, \ldots$ or $\omega_{n-1}$ correspond to the instantaneous angular frequency W, and $\phi_0, \phi_1, \ldots \phi_{n-1}$ correspond to the phase PE on finishing the frame. As for $\theta_0, \theta_1, \ldots \theta_{n-1}$, the phases on finishing the oscillation of a cosine oscillator of FIG. 22 are referred to.

The following is introduced as the formula for evaluating a difference between the phase condition on finishing the waveform synthesis process and the phase condition of the original waveform on starting the next frame. Here, e is a natural logarithm.

[Formula 1]

$$\sum_{k=0}^{n-1} |a_k(e^{i\theta_k} - e^{i\phi_k})| = \sum_{k=0}^{n-1} a_k|(\cos\theta_k - \cos\phi_k) + i(\sin\theta_k - \sin\phi_k)| = \sum_{k=0}^{n-1} a_k\sqrt{\begin{matrix}(\cos^2\theta_k - 2\cos\theta_k\cos\phi_k + \cos^2\phi_k) + \\ (\sin^2\theta_k - 2\sin\theta_k\sin\phi_k + \sin^2\phi_k)\end{matrix}} = \sum_{k=0}^{n-1} a_k\sqrt{2\{1 - \cos(\theta_k - \phi_k)\}}$$

In the case of $\theta=\phi$, there is no phase difference and an evaluation formula is 0 as to any frequency component. The larger the phase difference is, the larger the value of the evaluation formula becomes. If the time stretch/pitch shift processing is performed, it is normally $\theta\neq\phi$ and the evaluation formula is not 0. Thus, a function F(t) is introduced, which is a function for evaluating the difference between the phase condition on finishing the waveform synthesis process and the phase condition of the original waveform in a position presumed to be shifted by "t" from the next frame starting position in the time domain. As a lead or a lag on the time axis corresponds to the linear phase lead or the linear phase lag, F(t) is the formula of Formula 2 in which $\phi_k$ of Formula 1 is replaced by $\phi_k+\omega_k t$.

[Formula 2]

$$F(t) = \sum_{k=0}^{n-1} |a_k(e^{i\theta_k} - e^{i(\phi_k+\omega_k t)})| = \sum_{k=0}^{n-1} a_k\sqrt{2\{1 - \cos(\theta_k - \phi_k - \omega_k t)\}}$$

The closer to 0 the evaluation function F(t) is, the less the phase difference becomes, and the higher the correlation as the waveform becomes. Therefore, it is possible to prevent noise offensive to the ear from being produced on the cross-fade process by acquiring a value $t_p$ at which the evaluation function F(t) becomes minimal, synthesizing the waveform presumed to be shifted by $t_p$ from the next frame starting position in the time domain in the original waveform and using it as the phase synchronization waveform.

The phase synchronization waveform generating unit 34 of FIG. 11 acquires this $t_p$ first. To acquire this, the value of the evaluation function F(t) is acquired in the range of a time domain $-t_w<t<t_w$, and the smallest F(t) should be taken as $t_p$. Size of $t_w$ should be the length equivalent to several wavelengths of the frequency component included in the band. If $t_w$ is too small, a point where the value of F(t) is small may not be found. Inversely, if $t_w$ is large, an error occurs in the evaluation of F(t) at a point where t is too distant from 0.

The error occurring to the evaluation function F(t) is caused by use of the instantaneous angular frequencies $\omega_0, \omega_1, \ldots \omega_{n-1}$ in the formula. Here, $\omega_0, \omega_1, \omega_{n-1}$ are instantaneous values which essentially change over time. The formula of F(t) uses fixed values of $\omega_0, \omega_1, \ldots \omega_{n-1}$, and so it is not suited to the evaluation of the phase condition because, as t goes away from 0, it becomes totally different from a primary phase condition of the original waveform. For that reason, it is important to set the value of $t_w$ at an adequate value which is not too large. For the same reason, it is also thinkable to devise ways of obtaining the phase synchronization waveform which is closer to the phase condition of the original waveform by inclining so that the value of F(t) becomes smaller in proximity to t=0 and $t_p$ takes a value close to 0.

Figure 24:
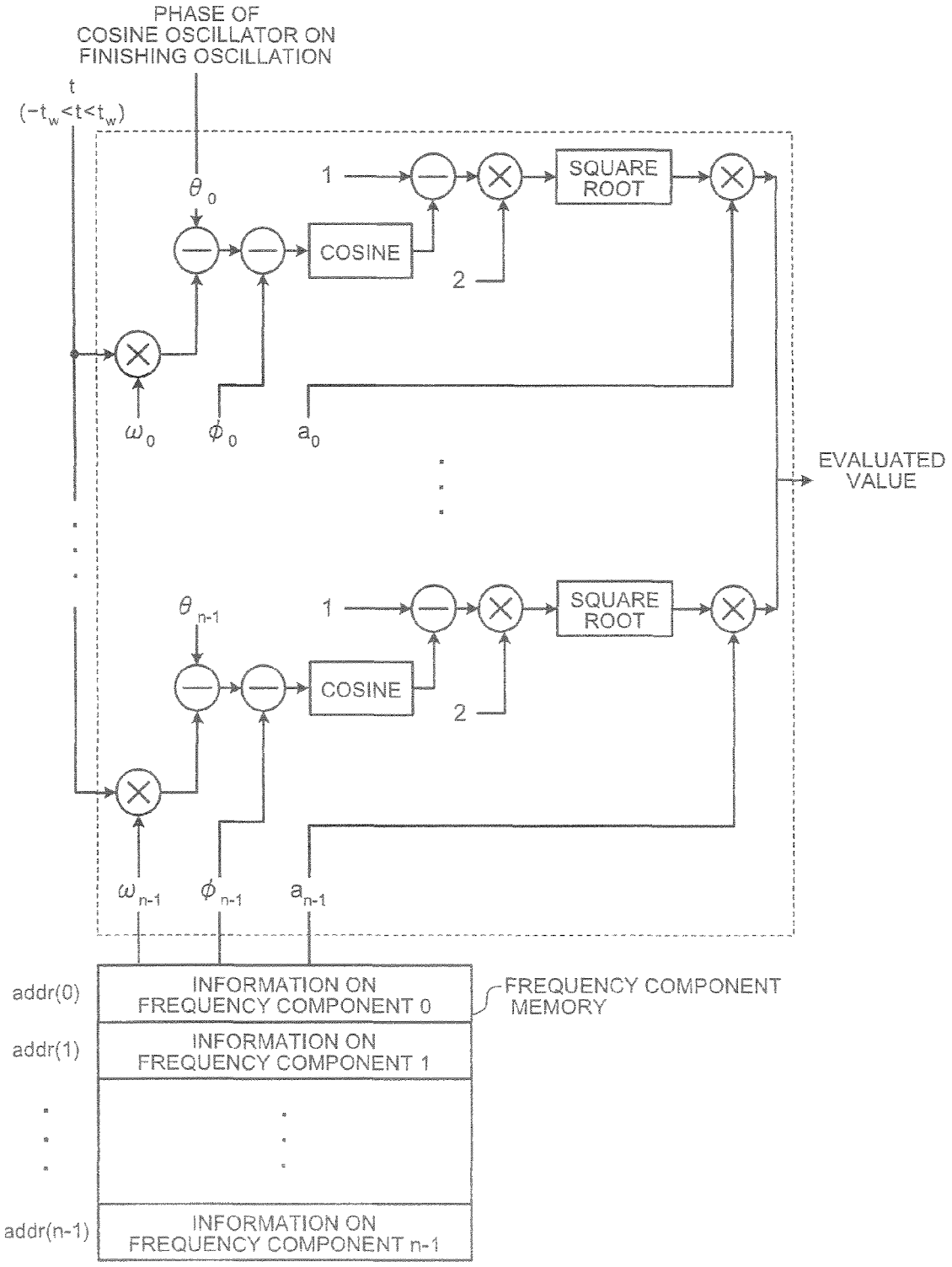
FIG. 24 is a block diagram for describing a method of acquiring an evaluated value of a phase difference by using an evaluation function.

FIG. 24 shows details of a calculation of the evaluation function F(t). The frequency component information analyzed by the band component synthesizing units 26 of FIG. 9 is stored in a frequency component memory of FIG. 24. The evaluated value is calculated in conjunction with the phases on finishing the oscillation of the cosine oscillator of the band component synthesizing units 26 and a variable t in the time domain. In FIG. 24, it is presumed that there are n pieces of frequency components so that the values are acquired as to each of the components by using the multiplication, subtraction, cosine, and square root. The evaluated value is calculated by adding up these values. FIG. 24 represents the calculation of Formula 2 in a block diagram. The evaluated value is acquired while changing the variable t in the range of $-t_w$ to $t_w$, and the variable t when the evaluated value becomes smallest is taken as $t_p$.

Next, the phase synchronization waveform is synthesized based on the acquired $t_p$. As for the synthesis process, the sine or cosine oscillation is performed for each channel while performing the pitch shifting as with the time stretch/pitch shift processing units 31 of FIG. 10. The phase synchronization waveform is only used for the cross-fade process. Therefore, the length equivalent to several wavelengths of the frequency component included in the band is sufficient as the length for synthesizing the waveform, and the time stretch can be ignored. In this case, it is necessary to adjust the phase condition when starting the oscillation so that the phase condition at the end of the phase synchronization waveform is put in the linear phase lead or linear phase lag state by an equivalent of $t_p$ from the phase condition of the original waveform when starting the next frame.

The phase synchronization waveform synthesized as above is outputted to the cross-fade processing unit 35 of FIG. 11. The cross-fade processing unit 35 performs the cross-fade process to the phase synchronization waveforms from the waveforms after the band component synthesis accumulated in the buffering processing unit 33. The cross-fade process is performed by mutually aligning the ends of the waveforms. As for the waveforms after the cross-fade process, the phase condition at the ends thereof is the same as the phase condition at the ends of the phase synchronization waveforms, which is accordingly the linear phase lead or linear phase lag state of the phase condition of the original waveforms. To be more specific, the waveforms after the cross-fade process have the phase condition equal to the original waveforms. The waveforms after the cross-fade process are outputted as final band waveforms.

The $t_p$ acquired by the phase synchronization waveform generating unit 34 of FIG. 11 is outputted as the phase correction value to the band component synthesizing units 26 of FIG. 9. As previously described, if the phase correction value is outputted, the phase when starting the synthesis process of the next frame is put in the linear phase lead or linear phase lag state of the phase condition of the original waveform. Thus, the waveforms smoothly connecting to the waveforms after the cross-fade process are synthesized by the next frame.

Figure 25:
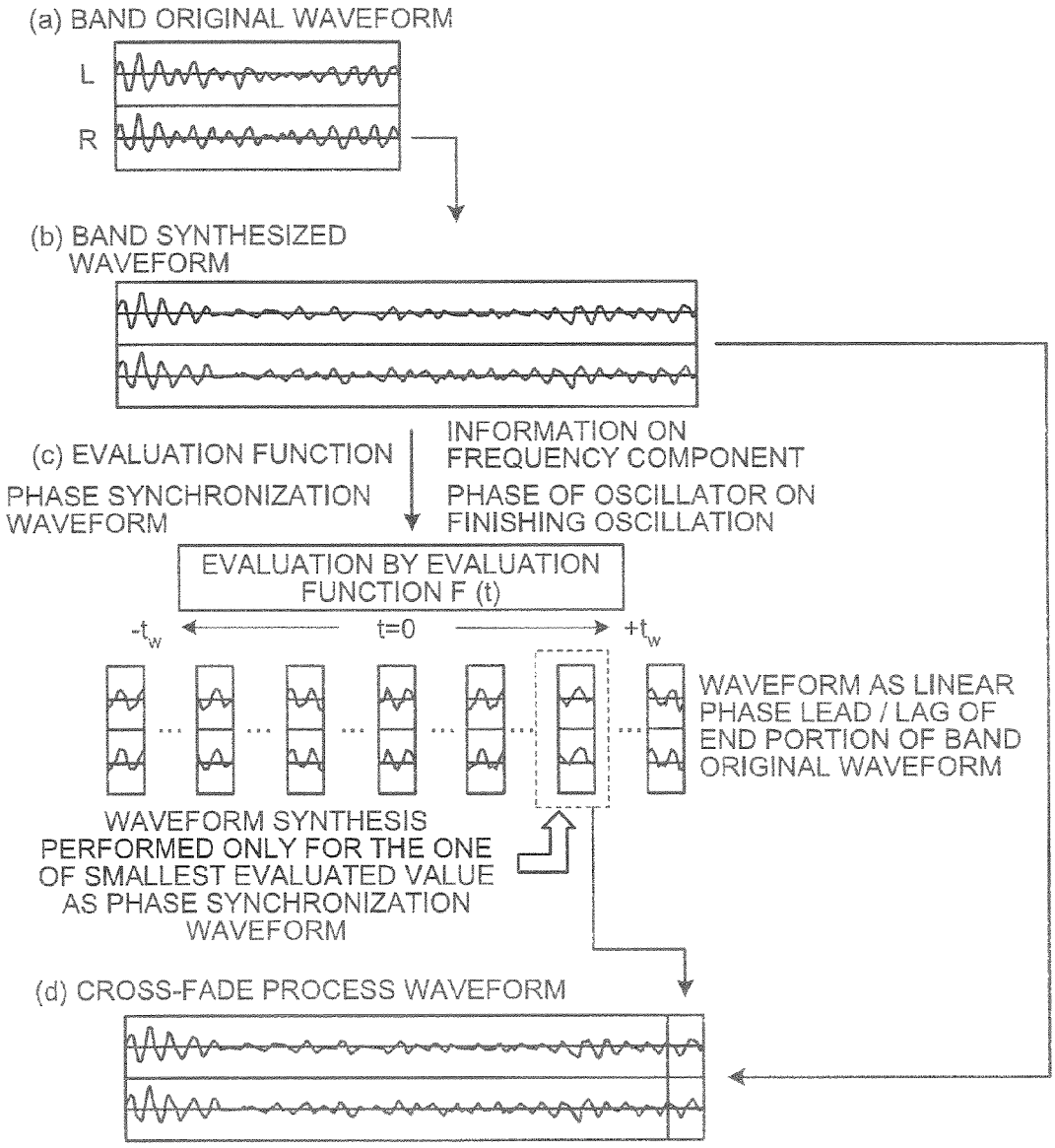
FIG. 25 is a block diagrams for describing details of evaluation of the waveform similarity evaluation unit.

A description will be given by using FIG. 25 as to the concept of the phase synchronization waveform generating unit 34 and the cross-fade processing unit 35 of FIG. 11 described so far. In FIG. 25, two channels of the stereo audio waveform are dividedly drawn in two tiered stages, which indicates that the similarity evaluation, phase synchronization waveform generation, and cross-fade process are performed in stereo.

A portion (a) of FIG. 25 shows the band original waveform, which is presumed undergoing twice time-stretching. A band synthesized waveform (b) of FIG. 25 stretched to twice is accumulated in the buffering processing unit 33 based on the band original waveform according to the processing described so far. The band synthesized waveform is a waveform which has the band original waveform time-stretched to twice. However, the phase relation of the frequency components at the ends has become totally different from that of the band original waveform, which is a cause of the auditory sense of discomfort due to, for example, a lack of feeling of normalcy in stereo.

A portion (c) of FIG. 25 shows the evaluation function F(t) and an appearance of generation of the phase synchronization waveform. The evaluated value is calculated while changing the variable t in the range of $-t_w$ to $t_w$, as described by using FIG. 24 based on the frequency component information analyzed on generating the band synthesized waveform and the phases on finishing the oscillation of the oscillator. The waveform which is the linear phase lead or lag of the end of the band original waveform on changing t is shown in the middle portion of the portion (c) of FIG. 25. This shows what the waveform of the linear phase lead or linear phase lag is like, and the process is not actually performed for all t but only for t when the evaluated value is smallest as the phase synchronization waveform in the waveform synthesis. In the portion (c) of FIG. 25 the length of the waveform synthesized in this case is a length equivalent to two wavelengths of the frequency component included in the band.

A portion (d) of FIG. 25 shows the waveform after the cross-fade process. The cross-fade process is performed by aligning the end of the band synthesized waveform of the portion (b) of FIG. 25 and the end of the phase synchronization waveform synthesized in the portion (c) of FIG. 25. The end of the waveform after the cross-fade process has the same value as the end of the phase synchronization waveform, which is accordingly the linear phase lead or lag state of the band original waveform. Thus, ever if the audio input waveform is stereo, the phase relation of the frequency components is very close to the band original waveform, and so the phase synchronization has been performed.

Figure 26:
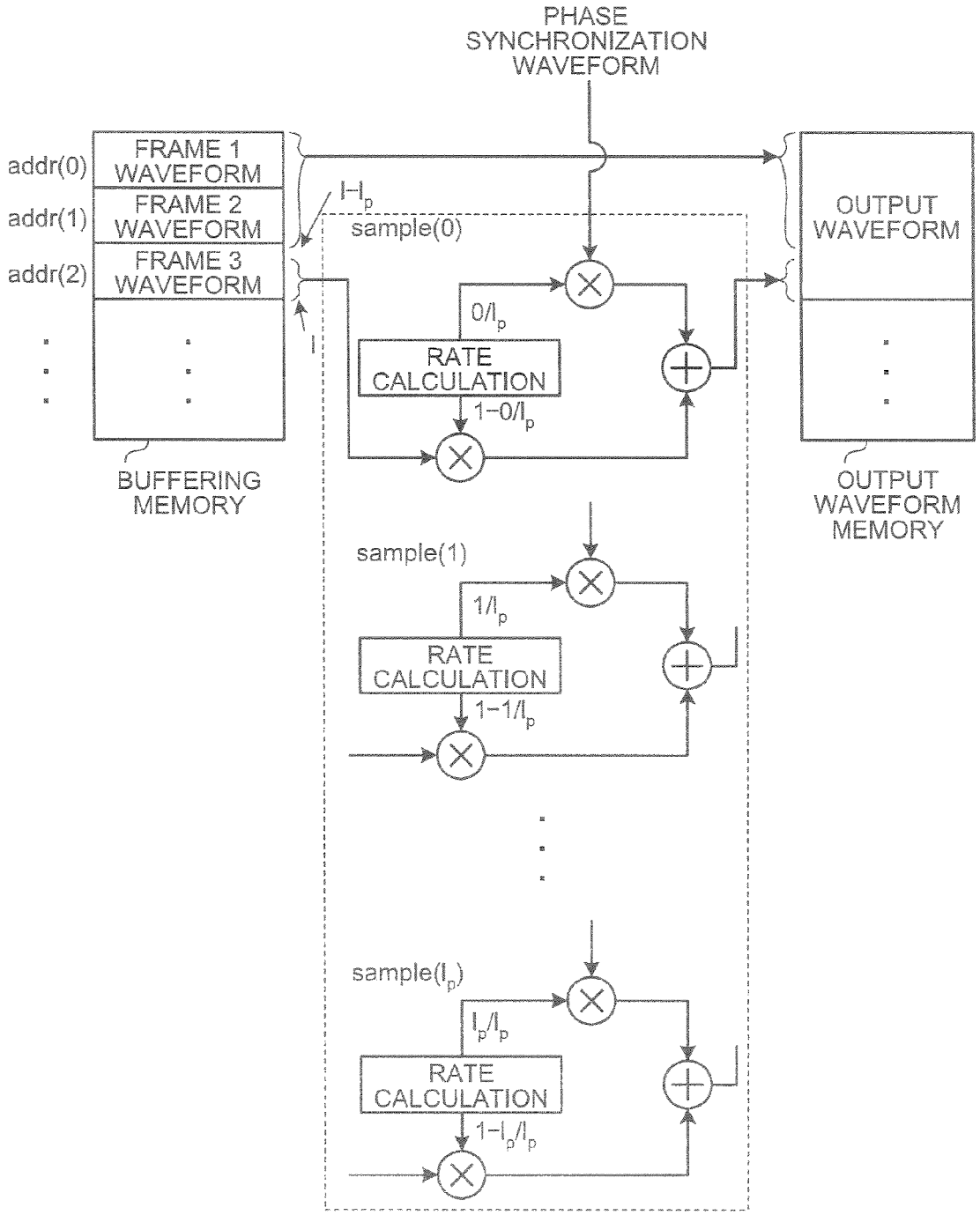
FIG. 26 is a block diagram for describing details of the cross-fade process.

FIG. 26 shows details of the cross-fade process. In FIG. 26, it is presumed that the length of the waveform necessary for the phase synchronization processing is equivalent to three frames (phase synchronization processing period). The buffering memory has frame synthesized waveforms accumulated therein by the buffering processing unit 33 of FIG. 11. The phase synchronization waveform is generated by the phase synchronization waveform generating unit 34. In this case, if the length of the band synthesized waveform accumulated in the buffering memory is l and the length of the phase synchronization waveform is $l_p$, the cross-fade process is started from a point of $l-l_p$ on the band synthesized waveform so as to align the ends of the two waveforms. The cross-fade process performs the rate calculation and multiplication of each waveform as to each sample point to output the sum of the values after the multiplication. The rate calculation of FIG. 26 shows an example of a cross-fade by linear interpolation. The waveform before $l-l_p$ is stored as-is as the output waveform in the output waveform memory.

The above processing is performed to each bands and a band waveform output is added to acquire a final audio output waveform.

Fifth Embodiment

The fourth embodiment has described the example of implementing the waveform processing by performing the band division on the audio input waveform. However, the same waveform processing as described in the fourth embodiment can be realized by using the below-mentioned structure which do not perform the band division on the audio input waveform. In FIG. 9, the frequency band dividing unit 24, the band component synthesizing unit (band 1) 26-1 to the band component synthesizing unit (band 5) 26-5 and the phase synchronization processing unit (band 1) 27-1 to the phase synchronization processing unit (band 5) 27-5 are deleted, and the audio input waveform 23 is directly inputted to the band component synthesizing unit (band 0) 26-0 so as to implement the same waveform processing as described in the fourth embodiment.

Sixth Embodiment

Next, a computer program that is a sixth embodiment and causes the above-mentioned structure/method of the fourth and the fifth embodiments to be performed will be described. FIG. 20 shows a flowchart of the computer program. First, the input waveform data is read (step S1), and the frequency band dividing process (step S2) which is the same as that of the frequency band dividing unit 24 of FIG. 9 is performed so as to output the waveform of each band. This process is composed of an instruction group such as multiplications and additions for realizing the band-pass filter or an instruction group for executing the FFT in the case of realizing the band division by the Fourier transform.

Next, an analytical process is performed as to the instantaneous amplitude, angular frequency, and phases of the band waveform data having undergone the frequency band division (step S3). This process is a part equivalent to the frequency analysis units 30-0 to 30-1 of FIG. 10 and is composed of an instruction group for executing the FFT and instruction groups of the square roots for calculating the amplitude, arctans for calculating the phases, and the like.

The waveform synthesis process (step S4) is executed based on the analyzed data. This process is the same process as that of the time stretch/pitch shift processing units 31-0 to 31-1 of FIG. 10. It is composed of instruction groups such as the cosine functions for playing a role of an oscillator and multiplications for multiplying the amplitudes, where the time stretched and/or pitch-shifted waveform is synthesized.

Next, it is determined whether or not the length of the synthesized waveform has reached the length necessary for the phase synchronization processing (step S5). In the case where the necessary length has not been reached the procedure returns to the step S1 to repeat the process until the necessary length is reached while accumulating the synthesized waveforms in the memory. In the case where the necessary length has been reached, the procedure moves on to the next step. This process is the same process as that of the buffering processing unit 33 of FIG. 11.

The phase synchronization processing (step S6) is performed to the synthesized waveform. This processing is equivalent to the processing of the phase synchronization waveform generating unit 34 and the cross-fade processing unit 35 of FIG. 11. This processing is composed of an instruction group of subtractions, multiplications, cosines, and square roots for executing a phase evaluation function and the like and an instruct-on group of multiplications and additions for performing the cross-fade process.

The processing of the step S2 to the step S6 is performed as to each of the bands having undergone the band division, and the output waveform data of each band is added up to execute the output waveform data writing (step S7). An instruction of addition is used to add up the output waveform data of the bands. Next, it is determined whether or not the processing has been finished as to the entire input waveform (step S8). If the processing has not been finished, the procedure returns to the step S1 to repeat the processing. If the processing has been finished as to the entire input waveform, the processing is finished.

INDUSTRIAL APPLICABILITY

According to one aspect of the present invention, the frequency analysis and the synthesis process of the audio signal are performed as to each of the bands divided into multiple frequency bands to evaluate the similarity between the original waveform and the waveform after the synthesis process as to each band. The cross-fade process is performed at the locations of high similarity between the waveform after the synthesis process and the band original waveform so that the phase change occurring on the waveform synthesis can be reset. Thus, it is possible to obtain the audio output of high quality which does not cause auditory sense of discomfort.

According to another aspect of the present invention, the similarity between the original waveform and the waveform after the synthesis process is evaluated by regarding the audio waveform as-is as one band without performing the band division. The cross-fade process is performed at the locations of high similarity between th waveform after the synthesis process and the original waveform so that the phase change occurring on the waveform synthesis can be reset. Thus, it is possible to realize the audio output of high quality which does not cause auditory sense of discomfort with a smaller number of parts so as to realize a lower price of an audio waveform synthesizing device.

According to another aspect of the present invention, the audio waveform processing method of the present invention can be performed by a commercially available audio processing program for a personal computer so that vocoder-method audio processing of high quality can be realized at even lower prices.

According to another aspect of the invention, the frequency analysis and the synthesis process are performed as to each of the bands of the audio signal divided into multiple frequency bands. The phase condition after the synthesis process of each band is compared with the phase condition of the original waveform to generate the waveform which is highly correlated with the phase condition after the synthesis process and is a linear phase lead or a linear phase lag of the original waveform as a phase synchronization waveform. The cross-fade process is performed to turn the waveform after the synthesis process to a phase synchronization waveform so that the phase change occurring on the waveform synthesis can be reset. Thus, it is possible to obtain the audio output of high quality which does not cause auditory sense of discomfort.

According to another aspect of the present invention, the audio waveform is processed by regarding it as-is as one band without performing the band division in the frequency band division of the apparatus of the present invention. Thus, it is possible to realize the audio output of high quality which does not cause auditory sense of discomfort with a smaller number of parts so as to realize lower prices of an audio waveform synthesizing device.

According to another aspect of the present invention, the audio waveform processing method of the present invention can be performed by a commercially available audio processing program for a personal computer so that vocoder-method audio processing of high quality can be realized at even lower prices.

According to one aspect of the present invention, a distance on a complex-number plane between the waveforms is used as an evaluation function for evaluating the difference between the phase condition after the waveform synthesis process of each band and the phase condition of the original waveform of each band. Thus, it is possible to evaluate the difference in the phase condition by a relatively simple method so as to promote simplification and speeding-up of the audio waveform synthesizing device.

To be more specific, the effect of using the audio signal processing apparatus, method, and program of the present invention is that, whether the audio input waveform is monaural or stereo, the phase change invariably occurring in the conventional vocoder method is reduced through the entire waveform so that the time stretch and pitch shift processing of high quality can be realized.

The invention claimed is:

1. An audio signal processing apparatus comprising:

a central processing unit, wherein the central processing unit includes:

a frequency band dividing unit that divides an input audio signal into a plurality of bands;

a plurality of time stretch/pitch shift processing units that perform at least one of time stretching and pitch shifting respectively by carrying out sine or cosine oscillation of each frequency component on the basis of a result of frequency analysis of a band-divided audio signal obtained as a result of division into the plurality of bands and a required time stretch/pitch shift amount, and performing a synthesis process; and a plurality of phase synchronization processing units that perform phase synchronization process for adjusting phases of time stretch/pitch shift signals outputted by the plurality of time stretch/pitch shift processing units, respectively, the audio signal processing apparatus thereby synthesizing outputs of the plurality of phase synchronization processing units and outputting a result, wherein each of the phase synchronization processing units includes a reference signal generating unit that clips a waveform of an end portion in one frame from the band-divided audio signal once every plurality of frames and transforms the clipped waveform of the end portion on the basis of the time stretch/pitch shift amount to generate and output a reference signal for the phase synchronization process, a cross-fade location calculating unit that calculates cross-fade locations for the phase synchronization process in the plurality of frames, and a cross-fade processing unit that performs a cross-fade process on the time stretch/pitch shift signal, wherein the cross-fade location calculating unit searches a tail portion of a time axis waveform of the time stretch/pitch shift signal in a plurality of frames for the cross-fade locations and detects the cross-fade locations, cross-fade locations being locations at which the time axis waveform of the time stretch/pitch shift signal in the plurality of frames is similar to a waveform of the reference signal on a time axis, and the cross-fade processing unit performs a cross-fade process in a range of a length corresponding to the waveform of the reference signal from the cross-fade position from the time stretch/pitch shift signal to the reference signal at each of the detected cross-fade locations.

2. The audio signal processing apparatus according to claim 1, wherein the cross-fade location calculating unit finds the cross-fade locations by using a predetermined evaluation function that evaluates the similarity.

3. The audio signal processing apparatus according to claim 1, wherein the cross-fade processing unit outputs a difference between a signal length after the cross-fade process and an original signal length as a stretch correction value, and the time stretch/pitch shift processing unit uses the stretch correction value to correct a next signal length.

4. The audio signal processing apparatus according to claim 2, wherein the cross-fade location calculating unit creates a weighting gradient on the evaluation function so that an evaluation of the similarity is higher toward the tail portion of the time stretch/pitch shift signal in the plurality of frames.

5. An audio signal processing apparatus comprising:

a central processing unit, wherein the central processing unit includes:

a time stretch/pitch shift processing unit that performs each of at least one of time stretching and pitch shifting by carrying out sine or cosine oscillation of each frequency component on the basis of a result of frequency analysis of an input audio signal and a required time stretch/pitch shift amount, and performing a synthesis process; and a phase synchronization processing unit that performs phase synchronization process for adjusting a phase of a time stretch/pitch shift signal outputted by the time stretch/pitch shift processing unit and outputs a resulting signal, wherein the phase synchronization processing unit includes a reference signal generating unit that clips a waveform of an end portion in one frame from the input audio signal once every plurality of frames and transforms the clipped waveform of the end portion on the basis of the time stretch/pitch shift amount to generate and output a reference signal for the phase synchronization process, a cross-fade location calculating unit that calculates cross-fade locations for the phase synchronization process in the plurality of frames, and a cross-fade processing unit that performs a cross-fade process on the time stretch/pitch shift signal, wherein the cross-fade location calculating unit searches a tail portion of a time axis waveform of the time stretch/pitch shift signal in a plurality of frames for the cross-fade locations and detects the cross-fade locations, cross-fade locations being locations at which the time axis waveform of the time stretch/pitch shift signal in the plurality of frames is similar to a waveform of the reference signal on a time axis, and the cross-fade processing unit performs a cross-fade process in a range of a length corresponding to the waveform of the reference signal from the cross-fade position from the time stretch/pitch shift signal to the reference signal at each of the detected cross-fade locations.

6. An audio signal processing apparatus comprising:

a central processing unit, wherein the central processing unit includes:

a frequency band dividing unit that divides an input audio signal into a plurality of bands;

a plurality of time stretch/pitch shift processing units that perform at least one of time stretching and pitch shifting respectively by carrying out sine or cosine oscillation of each frequency component on the basis of a result of frequency analysis of a band-divided audio signal obtained as a result of division into the plurality of bands and a required time stretch/pitch shift amount, and performing a synthesis process; and a plurality of phase synchronization processing units that perform phase synchronization process for adjusting phases of time stretch/pitch shift signals outputted by the plurality of time stretch/pitch shift processing units, respectively, the audio signal processing apparatus thereby synthesizing outputs of the plurality of phase synchronization processing units and outputting a result, wherein each of the phase synchronization processing units includes a phase synchronization signal generating unit that generates a phase synchronization, and a cross-fade processing unit that performs a cross-fade process on the time stretch/pitch shift signal, wherein the phase synchronization signal generating unit evaluates a difference in phase condition between an end portion of a waveform of the time stretch/pitch shift signal in a current frame on which the time stretch/pitch shift processing is performed and a waveform of the band-divided audio signal at a location where a next frame starts, by shifting the location at which the next frame of the waveform of the band-divided audio signal starts, along a time axis, calculates a time shift amount when the difference in phase condition is evaluated as the smallest clips of a signal waveform corresponding to a predetermined wavelength from the end portion of the band-divided audio signal, and generates at least one of a phase-lead signal and a phase-lag signal which is shifted by the time shift amount from the clipped waveform of the end portion as the phase synchronization signal, and the cross-fade processing unit that performs a cross-fade process from the time stretch/pitch shift signal to the phase synchronization signal in a range of the predetermined wavelength at the end portion of the time stretch/pitch shift signal.

7. The audio signal processing apparatus according to claim 6, wherein each of the phase synchronization processing units uses a distance on a complex-number plane between the end portion of the waveform of the time stretch/pitch shift signal in the current frame on which time the stretch/pitch shift processing is performed and the waveform of the band-divided audio signal at the location where the next frame starts, as an evaluation function for evaluating the difference in phase condition between the end portion of the waveform of the time stretch/pitch shift signal in the current frame on which the time stretch/pitch shift processing is performed and the waveform of the band-divided audio signal at the location where the next frame starts.

8. The audio signal processing apparatus according to claim 7, wherein the phase synchronization signal generating unit calculates a phase correction value for the phase synchronization process in the next frame on the bases of the time shift amount, and the time stretch/pitch shift processing unit corrects a phase of the time stretch/pitch shift signal at the start of the next frame on the basis of the phase correction value outputted by the phase synchronization signal generating unit.

9. The audio signal processing apparatus according to claim 7, wherein each of the phase synchronization processing units performs a weighting on evaluating the difference in phase condition so that an evaluation value that evaluates the difference in phase condition is smaller as the time shift amount is away from the location where the next frame of the waveform of the band-divided audio signal starts.

10. An audio signal processing apparatus comprising:

a central processing unit, wherein the central processing unit includes:

a time stretch/pitch shift processing unit that performs each of at least one of time stretching and pitch shifting by carrying out sine or cosine oscillation of each frequency component on the basis of a result of frequency analysis of an input audio signal and a required time stretch/pitch shift amount, and performing a synthesis process; and a phase synchronization processing unit that performs phase synchronization process for adjusting a phase of a time stretch/pitch shift signal outputted by the time stretch/pitch shift processing unit and outputs a resulting signal, wherein the phase synchronization processing unit includes a phase synchronization signal generating unit that generates phase synchronization signal, and a cross-fade processing unit that performs a cross-fade process on the time stretch/pitch shift signal, wherein the phase synchronization signal generating unit evaluates a difference in phase condition between an end portion of a waveform of the time stretch/pitch shift signal in a current frame on which the time stretch/pitch shift processing is performed and a waveform of the band-divided audio signal at a location where a next frame starts, by shifting the location at which the next frame of the waveform of the band-divided audio signal starts, along a time axis, calculates a time shift amount when the difference in phase condition is evaluated as the smallest clips of a signal waveform corresponding to a predetermined wavelength from the end portion of the band-divided audio signal, and generates at least one of a phase-lead signal and a phase-lag signal which is shifted by the time shift amount from the clipped waveform of the end portion as the phase synchronization signal, and the cross-fade processing unit that performs a cross-fade process from the time stretch/pitch shift signal to the phase synchronization signal in a range of the predetermined wavelength at the end portion of the time stretch/pitch shift signal.

11. An audio signal processing method comprising:

time stretching/pitch shifting of performing each of at least one of time stretching and pitch shifting by carrying out sine or cosine oscillation of each frequency component on the basis of a result of frequency analysis of an input audio signal and a required time stretch/pitch shift amount, and performing a synthesis process; and phase synchronization processing of performing a phase synchronization process for adjusting a phase of a time stretch/pitch shift signal on which time stretch/pitch shift processing is performed, wherein the phase synchronization processing includes reference signal generating of clipping a waveform of an end portion in one frame from the input audio signal once every plurality of frames and transforming the clipped waveform of the end portion on the basis of the time stretch/pitch shift amount to generate and output a reference signal for the phase synchronization process, cross-fade location calculating of calculating cross-fade locations for the phase synchronization process in the plurality of frames, and cross-fade processing of performing a cross-fade process on the time stretch/pitch shift signal, wherein the cross fade location calculating includes searching a tail portion of a time axis waveform of the time stretch/pitch shift signal in a plurality of frames for the cross fade locations and detects the cross-fade locations, cross-fade locations being locations at which the time axis waveform of the time stretch/pitch shift signal in the plurality of frames is similar to a waveform of the reference signal on a time axis, and the cross-fade processing includes performing a cross-fade process in a range of a length corresponding to the waveform of the reference signal from the cross-fade position from the time stretch/pitch shift signal to the reference signal at each of the detected cross-fade locations.

12. The audio signal processing method according to claim 11, wherein in the cross-fade location calculating, the cross-fade locations are calculated by means of a predetermined evaluation function that evaluates the similarity, and a weighting gradient is created on the evaluation function at a time of calculating the cross-fade locations so that an evaluation of the similarity is higher toward a tail portion of the time stretch/pitch shift signal in the plurality of frames, in the cross-fade processing, a difference between a signal length after the cross-fade process and an original signal length is outputted as a stretch correction value, and in the time stretch/pitch shift processing, the stretch correction value is used to correct a next signal length.

13. The audio signal processing method according to claim 11, wherein the input audio signal is divided into a plurality of bands, each of processes in the time stretching/pitch shifting and the phase synchronization processing is performed on each of band-divided audio signals obtained as a result of division into the plurality of bands, and the audio signals processed are synthesized and outputted.

14. An audio signal processing method comprising:

time stretching/pitch shifting of performing each of at least one of time stretching and pitch shifting by carrying out sine or cosine oscillation of each frequency component on the basis of a result of frequency analysis of an input audio signal and a required time stretch/pitch shift amount, and performing a synthesis process; and phase synchronization processing of performing a phase synchronization process for adjusting a phase of a time stretch/pitch shift signal on which time stretch/pitch shift processing is performed, wherein the phase synchronization processing includes phase synchronization signal generating of generating a phase synchronization signal, and cross-fade processing of performing a cross-fade process on the time stretch/pitch shift signal, wherein the phase synchronization processing further includes evaluating of evaluating a difference in phase condition between a waveform of an end portion of the time stretch/pitch shift signal in a current frame on which the time stretch/pitch shift processing is performed and a waveform of the input audio signal at a location where a next frame starts, by shifting the location where the next frame of the waveform of the input audio signal starts along a time axis, and time shift calculating of calculating a time shift amount when the difference in phase condition is evaluated as the smallest, wherein the phase synchronization signal generating includes clipping a signal waveform corresponding to a predetermined wavelength at the end portion of the input audio signal, and generating one of a phase-lead signal and a phase-lag signal which is shifted by the time shift amount from the clipped waveform of the end portion as a phase synchronization signal, and the cross-fade processing including performing a cross-fade process from the time stretch/pitch shift signal to the phase synchronizing signal in a range of the predetermined wavelength at the end portion of the time stretch/pitch shift signal.

15. The audio signal processing method according to claim 14, further comprising phase correction value calculating of calculating a phase correction value for the phase synchronization process in the next frame on the basis of the time shift amount, wherein in the phase synchronization processing, a distance on a complex-number plane between the end portion of the waveform of the time stretch/pitch shift signal in the current frame on which the time stretch/pitch shift processing is performed and the waveform of the input audio signal at the location where the next frame starts is used as an evaluation function for evaluating the difference in phase condition between the end portion of the waveform of the time stretch/pitch shift signal in the current frame on which the time stretch/pitch shift processing is performed and the waveform of the input audio signal at the location where the next frame starts, and a weighting is performed at a time of evaluating the difference in phase condition so that an evaluation value that evaluates the difference in phase condition is smaller as the time shift amount is away from the location where the next frame of the waveform of the input audio signal starts, and in the time stretch/pitch shift processing, a phase of the time stretch/pitch shift signal at the start of the next frame is corrected on the basis of the phase correction value generated in the phase correction value calculating.

16. The audio signal processing method according to claim 14, wherein the input audio signal is divided into a plurality of bands, each of processes in the time stretching/pitch shifting and the phase synchronization processing is performed on each of band-divided audio signals obtained as a result of division into the plurality of bands, and the audio signals processed are synthesized and outputted.

17. A computer program product having a non-transitory computer readable medium including programmed instructions, wherein the instructions, when executed by a computer, cause the computer to perform the method according to claim 11.

18. A computer program product having a non-transitory computer readable medium including programmed instructions, wherein the instructions, when executed by a computer, cause the computer to perform the method according to claim 14.

* * * * *